US007539559B2

(12) United States Patent
Kanai et al.

(10) Patent No.: US 7,539,559 B2
(45) Date of Patent: May 26, 2009

(54) CONTROL UNIT, CONTROL METHOD, CONTROL PROGRAM, COMPUTER-READABLE RECORD MEDIUM WITH CONTROL PROGRAM, AND CONTROL SYSTEM

(75) Inventors: Etsuko Kanai, Kyoto (JP); Masami Funakura, Osaka (JP)

(73) Assignee: Panasonic Corporation, Osaka (JP)

( * ) Notice: Subject to any disclaimer, the term of this patent is extended or adjusted under 35 U.S.C. 154(b) by 441 days.

(21) Appl. No.: 11/578,087

(22) PCT Filed: Nov. 17, 2005

(86) PCT No.: PCT/JP2005/021133

§ 371 (c)(1),
(2), (4) Date: Oct. 12, 2006

(87) PCT Pub. No.: WO2006/059489

PCT Pub. Date: Jun. 8, 2006

(65) Prior Publication Data

US 2007/0244602 A1 Oct. 18, 2007

(30) Foreign Application Priority Data

Dec. 2, 2004 (JP) ..... 2004-349343
Jan. 27, 2005 (JP) ..... 2005-019401

(51) Int. Cl.
*G05B 13/00* (2006.01)
*G05B 21/00* (2006.01)
*G05D 23/00* (2006.01)

(52) U.S. Cl. ..... 700/277; 700/276; 700/278; 165/11.1; 236/1 B; 236/91 E; 236/91 F

(58) Field of Classification Search ..... 700/276–278; 165/11.1; 236/1 B, 91 E, 91 F
See application file for complete search history.

(56) References Cited

U.S. PATENT DOCUMENTS 4,433,809 A * 2/1984 Schulz ..... 236/47

(Continued)

FOREIGN PATENT DOCUMENTS

JP 2002-264627 9/2002
JP 2004-163088 6/2004

OTHER PUBLICATIONS

"Design of on-line models for multi-zone office air conditioning to aid commissioning and maintenance", Virk et al, University of Portsmouth Dept. of Electrical and Electronic Engineering. Date Unknown.*

(Continued)

*Primary Examiner*—Michael D Masinick
(74) *Attorney, Agent, or Firm*—Wenderoth, Lind & Ponack, L.L.P.

(57) ABSTRACT

A control unit is provided which is capable of estimating a user's environment based on time and temperature before entering an air-conditioned room, and reflecting a result obtained from the estimation in the control of air-conditioning equipment.

An interface section 105 receives user information indicating the state of a user in a first area and temperature data in the first area; a temperature-data recording section 107 records a period of time when the user has stayed in the first area, and by relating the temperature data to the period of time clocked by a timer section 106, records this temperature data as a temporal change in the temperature of the first area; a special-mode reference section 109 stores control information for changing the contents of a setting in air-conditioning equipment 104 provided in a second area; a special-mode time calculation section 110 calculates an execution time to execute a control operation of the air-conditioning equipment 104 based on the control information, using the period of time when the user has stayed in the first area, the temporal change in the temperature and a reference temperature which is a predetermined temperature; and an operation-data generation section 111 generates operation data for operating the air-conditioning equipment 104 during the execution time based on the control information.

18 Claims, 17 Drawing Sheets

U.S. PATENT DOCUMENTS 4,646,964 A * 3/1987 Parker et al. ..... 236/49.3
RE33,146 E * 1/1990 Carrell et al. ..... 165/11.1
5,105,366 A * 4/1992 Beckey ..... 700/276
5,395,042 A * 3/1995 Riley et al. ..... 236/46 R
5,595,342 A * 1/1997 McNair et al. ..... 236/51
5,682,949 A * 11/1997 Ratcliffe et al. ..... 165/209
6,062,482 A * 5/2000 Gauthier et al. ..... 236/11
6,349,883 B1 * 2/2002 Simmons et al. ..... 236/46 R
2003/0209893 A1 * 11/2003 Breed et al. ..... 280/735
2008/0083834 A1 * 4/2008 Krebs et al. ..... 237/2 A
2008/0099570 A1 * 5/2008 Krebs et al. ..... 236/46 R

OTHER PUBLICATIONS

"Are Energy Management Systems Cost Effective?", Gunterman. IEEE Transactions on Industrial Applications, vol. 1A-18, No. 6, Nov./Dec. 1982.*

* cited by examiner

FIG.3

| | |
|---|---|
| BATHING TIME ($t_b - t_a$) | 25 MINUTES |
| BATHROOM-TEMPERATURE CHANGE ($Tb_{ta} \rightarrow Tb_{tb}$) | 30°C → 32°C |
| REFERENCE TEMPERATURE (Tr) | 26°C |

FIG.9

| | |
|---|---|
| CLOTHES-CHANGING ROOM PRESENCE TIME ($t_c - t_b$) | 10 MINUTES |
| CLOTHES-CHANGING ROOM TEMPERATURE CHANGE ($Tb_{tb} \rightarrow Tb_{tc}$) | 29°C → 29°C |
| TEMPERATURE DIFFERENCE BETWEEN BATHROOM AND CLOTHES-CHANGING ROOM ($\Delta Ti'$) | 3°C |

FIG.12

| | | TEMPERATURE DIFFERENCE BETWEEN THE POINT P AND THE POINT F | | |
|---|---|---|---|---|
| | | NARROW | ↔ | WIDE |
| TIME INTERVAL BETWEEN THE POINT P AND THE POINT F | SHORT | WEAK ↓ MEDIUM ↓ STRONG | WEAK ↓ MEDIUM ↓ STRONG | WEAK ↓ MEDIUM ↓ STRONG |
| | ↕ | WEAK ↓ MEDIUM ↓ STRONG | WEAK ↓ MEDIUM ↓ STRONG | MEDIUM |
| | LONG | WEAK ↓ MEDIUM ↓ STRONG | MEDIUM | MEDIUM |

CONTROL UNIT, CONTROL METHOD, CONTROL PROGRAM, COMPUTER-READABLE RECORD MEDIUM WITH CONTROL PROGRAM, AND CONTROL SYSTEM

TECHNICAL FIELD

The present invention relates to a control unit, a control method, a control program, a computer-readable record medium where a control program is recorded, and a control system which are capable of controlling indoor air-conditioning equipment in consideration of an environment where a user has stayed.

BACKGROUND ART

At present, as a comfort index on thermal sensation, the PMV (or predicted mean vote) is generally well known which is an international standard in ISO7730. In recent years, air-conditioning equipment has become popular which executes air-conditioning control by calculating a PMV value and using this value. However, such air-conditioning control offers comfort to a user only after entering a room with air-conditioning equipment and starting to execute the air-conditioning control. In short, an environment before coming into the room is left out of account.

Hence, as a conventional environmental control system, a vehicle air conditioner is proposed which executes more thermally-comfortable air-conditioning control by taking into account an environment before an occupant gets in a car (e.g., refer to Patent Document 1). FIG. 17 is a block diagram, showing the configuration of the conventional vehicle air conditioner described in Patent Document 1.

In FIG. 17, a temperature sensor is embedded in a door-lock remote controller 1002, and this temperature sensor detects a user's body temperature. When a door is unlocked, a signal for unlocking it and data on the detected body temperature are transmitted by radio to a controller 1001. After receiving this body-temperature data, the controller 1001 adds the body-temperature data as one term to an arithmetic expression for calculating an unsteady SET* (or new standard effective temperature). Then, the value of an unsteady SET* is calculated using an interior temperature detected by a temperature detecting section 1003 and an ambient temperature at this time. Based on this calculated value, an actuator 1004 is controlled.

Patent Document 1: Japanese Patent Laid-Open No. 2002-264627 specification (FIG. 1)

DISCLOSURE OF THE INVENTION

However, according to the conventional configuration, a user's body temperature is detected immediately before entering the room (or in Patent Document 1, immediately before getting in the car). Thereby, the environment before coming into the room is estimated. Hence, air-conditioning control is suggested which is executed by considering the environment before the user enters the room. But it is difficult to realize, at a low cost, a section for detecting the body temperature in an instant. Besides, for example, until the body temperature is detected, the user is forced to make a body-temperature detection motion, such as keep grasping a door handle. This is very hard in the aspect of practicability and feasibility in real life.

In Patent Document 1, the following description is also given. It is more desirable that the time when an occupant has stayed outside of the vehicle, the quantity of solar radiation during this period and the like, as well as the body temperature, be taken into consideration. However, it does not disclose any specific method of adding those factors.

In order to resolve the above described disadvantages, it is an object of the present invention to provide a control unit, a control method, a control program, a computer-readable record medium where a control program is recorded, and a control system which are capable of estimating a user's environment based on time and temperature before entering a room with air-conditioning equipment, reflecting a result obtained from the estimation in the control of the air-conditioning equipment, and offering a more comfortable space to the user.

A control unit according to the present invention, comprising: a receiving section for receiving user information indicating the state of a user in a first area and temperature data in the first area; a clocking section for clocking a period of time when the user stays in the first area, based on the user information received by the receiving section; a temperature-data recording section for recording the period of time when the user stays in the first area which is clocked by the clocking section, and recording the temperature data received by the receiving section as a temporal change in the temperature of the first area by relating this temperature data to the period of time clocked by the clocking section; a control-information storing section for storing control information for changing the contents of a setting in air-conditioning equipment provided in a second area different from the first area; an execution-time calculating section for, using the period of time when the user stays in the first area, the temporal change in the temperature and a reference temperature that is a predetermined temperature which are recorded in the temperature-data recording section, calculating an execution time to execute a control operation of the air-conditioning equipment based on the control information stored in the control-information storing section; and an operation-data generating section for generating operation data for operating the air-conditioning equipment during the execution time calculated by the execution-time calculating section based on the control information stored in the control-information storing section.

Furthermore, a control method according to the present invention, including: a receiving step of receiving user information indicating the state of a user in a first area and temperature data in the first area; a clocking step of clocking a period of time when the user stays in the first area, based on the user information received in the receiving step; a temperature-data recording step of recording the period of time when the user stays in the first area which is clocked in the clocking step, and recording the temperature data received in the receiving step as a temporal change in the temperature of the first area by relating this temperature data to the period of time clocked in the clocking step; an execution-time calculating step of, using the period of time when the user stays in the first area, the temporal change in the temperature and a reference temperature that is a predetermined temperature which are recorded in the temperature-data recording step, calculating an execution time to execute a control operation of the air-conditioning equipment, based on control information stored in a control-information storing section for storing the control information for changing the contents of a setting in air-conditioning equipment provided in a second area different from the first area; and an operation-data generating step of, generating operation data for operating the air-conditioning equipment during the execution time calculated in the execution-time calculating step based on the control information stored in the control-information storing section.

Moreover, a control program according to the present invention, allowing a control unit to function as: a receiving section for receiving user information indicating the state of a user in a first area and temperature data in the first area; a clocking section for clocking a period of time when the user stays in the first area, based on the user information received by the receiving section; a temperature-data recording section for recording the period of time when the user stays in the first area which is clocked by the clocking section, and recording the temperature data received by the receiving section as a temporal change in the temperature of the first area by relating this temperature data to the period of time clocked by the clocking section; a control-information storing section for storing control information for changing the contents of a setting in air-conditioning equipment provided in a second area different from the first area; an execution-time calculating section for, using the period of time when the user stays in the first area, the temporal change in the temperature and a reference temperature that is a predetermined temperature which are recorded in the temperature-data recording section, calculating an execution time to execute a control operation of the air-conditioning equipment based on the control information stored in the control-information storing section; and an operation-data generating section for generating operation data for operating the air-conditioning equipment during the execution time calculated by the execution-time calculating section based on the control information stored in the control-information storing section.

In addition, a computer-readable record medium in which a control program is recorded according to the present invention, allowing a control unit to function as: a receiving section for receiving user information indicating the state of a user in a first area and temperature data in the first area; a clocking section for clocking a period of time when the user stays in the first area, based on the user information received by the receiving section; a temperature-data recording section for recording the period of time when the user stays in the first area which is clocked by the clocking section, and recording the temperature data received by the receiving section as a temporal change in the temperature of the first area by relating this temperature data to the period of time clocked by the clocking section; a control-information storing section for storing control information for changing the contents of a setting in air-conditioning equipment provided in a second area different from the first area; an execution-time calculating section for, using the period of time when the user stays in the first area, the temporal change in the temperature and a reference temperature that is a predetermined temperature which are recorded in the temperature-data recording section, calculating an execution time to execute a control operation of the air-conditioning equipment based on the control information stored in the control-information storing section; and an operation-data generating section for generating operation data for operating the air-conditioning equipment during the execution time calculated by the execution-time calculating section based on the control information stored in the control-information storing section.

According to these configurations, user information indicating the state of a user in a first area and temperature data in the first area are received. Based on the received user information, a period of time when the user has stayed in the first area is clocked. Then, the period of time when the user has stayed in the first area is recorded, and by relating the received temperature data to the clocked period of time, this temperature data is recorded as a temporal change in the temperature of the first area in a temperature-data recording section. In a control-information storing section, control information is stored for changing the contents of a setting in air-conditioning equipment provided in a second area different from the first area. Using the period of time when the user has stayed in the first area, the temporal change in the temperature and a reference temperature that is a predetermined temperature which are recorded in the temperature-data recording section, an execution time to execute a control operation of the air-conditioning equipment is calculated based on the control information stored in the control-information storing section. Operation data for operating the air-conditioning equipment during the calculated execution time is generated based on the control information stored in the control-information storing section.

Accordingly, using the period of time when the user has stayed in the first area and the temperature of the first area, an execution time is calculated to execute a control operation of the air-conditioning equipment disposed in the second area based on the control information stored in the control-information storing section. Therefore, the user's environment before entering a room with the air-conditioning equipment is estimated based on time and temperature. Then, a result obtained from the estimation is reflected in the control of the air-conditioning equipment. This helps offer a more comfortable space to the user.

Furthermore, a control unit according to the present invention, comprising: a receiving section for receiving user information indicating the state of a user in a bathroom and the state of the user in a bathtub, and temperature data in the bathroom and temperature data in the bathtub; a clocking section for clocking a period of time when the user stays in the bathroom and a period of time when the user stays in the bathtub, based on the user information received by the receiving section; a temperature-data recording section for recording the period of time when the user stays in the bathroom and the period of time when the user stays in the bathtub which are clocked by the clocking section, and recording the temperature data in the bathroom received by the receiving section as a temporal change in the temperature of the bathroom by relating this temperature data to the period of time clocked by the clocking section and the temperature data in the bathtub received by the receiving section as a temporal change in the temperature of the bathtub by relating this temperature data to the period of time clocked by the clocking section; a control-information storing section for storing control information for changing the contents of a setting in air-conditioning equipment provided in a place different from the bathroom; an execution-time calculating section for, using the period of time when the user stays in the bathroom, the period of time when the user stays in the bathtub, the temporal change in the temperature of the bathroom, the temporal change in the temperature of the bathtub, a predetermined numeric coefficient on the influence of the water inside of the bathtub on the human body, and a reference temperature that is a predetermined temperature which are recorded in the temperature-data recording section, calculating an execution time to execute a control operation of the air-conditioning equipment based on the control information stored in the control-information storing section; and an operation-data generating section for generating operation data for operating the air-conditioning equipment during the execution time calculated by the execution-time calculating section based on the control information stored in the control-information storing section.

According to this configuration, user information indicating the state of a user in a bathroom and the state of the user in a bathtub and temperature data in the bathroom and temperature data in the bathtub are received. Based on the received user information, a period of time when the user has stayed in the bathroom and a period of time when the user has stayed in the bathtub are clocked. Then, the clocked period of time when the user has stayed in the bathroom and the clocked period of time when the user has stayed in the bathtub are recorded, and by relating the received temperature data in the bathroom to the clocked period of time, this temperature data is recorded as a temporal change in the temperature of the bathroom, as well as, by relating the received temperature data in the bathtub to the clocked period of time, this temperature data is recorded as a temporal change in the temperature of the bath bathtub in a temperature-data recording section. In a control-information storing section, control information is stored for changing the contents of a setting in air-conditioning equipment provided in a place different from the bathroom. Then, using the period of time when the user has stayed in the bathroom, the period of time when the user has stayed in the bathtub, the temporal change in the temperature of the bathroom, the temporal change in the temperature of the bathtub, a predetermined numeric coefficient on the influence of the water inside of the bathtub on the human body, and a reference temperature that is a predetermined temperature which are recorded in the temperature-data recording section, an execution time to execute a control operation of the air-conditioning equipment is calculated-based on the control information stored in the control-information storing section. Thereafter, operation data for operating the air-conditioning equipment during the calculated execution time is generated based on the control information stored in the control-information storing section.

Therefore, in terms of the environment before the user moves to the place provided with the air-conditioning equipment, the fact that the user not only has stayed in the air but also has soaked in water (i.e., warm water) can be taken into account when the execution time for the air-conditioning equipment is calculated based on predetermined control information. Hence, a specialized system can be realized in a space like a bathroom which is a special environment where warm water as well as air exists together. This makes it possible to realize a more comfortable air-conditioning operation for the user.

Moreover, a control system according to the present invention, comprising: a control unit having a receiving section for receiving user information indicating the state of a user in a first area and temperature data in the first area, a clocking section for clocking a period of time when the user stays in the first area, based on the user information received by the receiving section, a temperature-data recording section for recording the period of time when the user stays in the first area which is clocked by the clocking section, and recording the temperature data received by the receiving section as a temporal change in the temperature of the first area by relating this temperature data to the period of time clocked by the clocking section, a control-information storing section for storing control information for changing the contents of a setting in air-conditioning equipment provided in a second area different from the first area, an execution-time calculating section for, using the period of time when the user stays in the first area, the temporal change in the temperature and a reference temperature that is a predetermined temperature which are recorded in the temperature-data recording section, calculating an execution time to execute a control operation of the air-conditioning equipment based on the control information stored in the control-information storing section, an operation-data generating section for generating operation data for operating the air-conditioning equipment during the execution time calculated by the execution-time calculating section based on the control information stored in the control-information storing section, and an operation-data transmitting section for transmitting the operation data generated by the operation-data generating section to the air-conditioning equipment; a state detecting section for detecting the state of the user in the first area and transmitting the user information indicating the state of the user to the control unit; a temperature detecting section for detecting the temperature of the first area and transmitting the temperature data in the first area to the control unit; and the air-conditioning equipment having an operation-data receiving section for receiving the operation data transmitted by the control unit and an operation executing section for executing an operation according to the operation data received by the operation-data receiving section.

According to this configuration, in a control unit, user information indicating the state of a user in a first area and temperature data in the first area are received. Based on the received user information, a period of time when the user has stayed in the first area is clocked. Then, the period of time when the user has stayed in the first area is recorded, and by relating the received temperature data to the clocked period of time, this temperature data is recorded as a temporal change in the temperature of the first area in a temperature-data recording section. In a control-information storing section, control information is stored for changing the contents of a setting in air-conditioning equipment provided in a second area different from the first area. Using the period of time when the user has stayed in the first area, the temporal change in the temperature and a reference temperature that is a predetermined temperature which are recorded in the temperature-data recording section, an execution time to execute a control operation of the air-conditioning equipment is calculated based on the control information stored in the control-information storing section. Operation data for operating the air-conditioning equipment during the calculated execution time is generated based on the control information stored in the control-information storing section. Then, the generated operation data is transmitted to the air-conditioning equipment. In a state detecting section, the state of the user in the first area is detected, and the user information indicating the state of the user is transmitted to the control unit. Further, a temperature detecting section detects the temperature of the first area, and the temperature data in the first area is transmitted to the control unit. Still further, in the air-conditioning equipment, the operation data transmitted by the control unit is received, and an operation is executed according to the received operation data.

Accordingly, using the period of time when the user has stayed in the first area and the temperature of the first area, an execution time is calculated to execute a control operation of the air-conditioning equipment disposed in the second area based on the control information stored in the control-information storing section. Therefore, the user's environment before entering a room with the air-conditioning equipment is estimated based on time and temperature. Then, a result obtained from the estimation is reflected in the control of the air-conditioning equipment. This helps offer a more comfortable space to the user.

Moreover, a control system according to the present invention, comprising: a control unit having a receiving section for receiving user information indicating the state of a user in a bathroom and the state of the user in a bathtub, and temperature data in the bathroom and temperature data in the bathtub, a clocking section for clocking a period of time when the user stays in the bathroom and a period of time when the user stays in the bathtub, based on the user information received by the receiving section, a temperature-data recording section for recording the period of time when the user stays in the bathroom and the period of time when the user stays in the bathtub which are clocked by the clocking section, and recording the temperature data in the bathroom received by the receiving section as a temporal change in the temperature of the bathroom by relating this temperature data to the period of time clocked by the clocking section and the temperature data in the bathtub received by the receiving section as a temporal change in the temperature of the bathtub by relating this temperature data to the period of time clocked by the clocking section, a control-information storing section for storing control information for changing the contents of a setting in air-conditioning equipment provided in a place different from the bathroom, an execution-time calculating section for, using the period of time when the user stays in the bathroom, the period of time when the user stays in the bathtub, the temporal change in the temperature of the bathroom, the temporal change in the temperature of the bathtub, a predetermined numeric coefficient on the influence of the water inside of the bathtub on the human body, and a reference temperature that is a predetermined temperature which are recorded in the temperature-data recording section, calculating an execution time to execute a control operation of the air-conditioning equipment based on the control information stored in the control-information storing section, an operation-data generating section for generating operation data for operating the air-conditioning equipment during the execution time calculated by the execution-time calculating section based on the control information stored in the control-information storing section, and an operation-data transmitting section for transmitting the operation data generated by the operation-data generating section to the air-conditioning equipment; a bathroom-state detecting section for detecting the state of the user in the bathroom and transmitting the user information indicating the state of the user to the control unit; a bathtub-state detecting section for detecting the state of the user in the bathtub and transmitting the user information indicating the state of the user to the control unit; a bathroom-temperature detecting section for detecting the temperature of the bathroom and transmitting the temperature data in the bathroom to the control unit; a bathtub-temperature detecting section for detecting the temperature of the bathtub and transmitting the temperature data in the bathtub to the control unit; and the air-conditioning equipment having an operation-data receiving section for receiving the operation data transmitted by the control unit and an operation executing section for executing an operation according to the operation data received by the operation-data receiving section.

According to this configuration, user information indicating the state of a user in a bathroom and the state of the user in a bathtub and temperature data in the bathroom and temperature data in the bathtub are received. Based on the received user information, a period of time when the user has stayed in the bathroom and a period of time when the user has stayed in the bathtub are clocked. Then, the clocked period of time when the user has stayed in the bathroom and the clocked period of time when the user has stayed in the bathtub are recorded, and by relating the received temperature data in the bathroom to the clocked period of time, this temperature data is recorded as a temporal change in the temperature of the bathroom, as well as, by relating the received temperature data in the bathtub to the clocked period of time, this temperature data is recorded as a temporal change in the temperature of the bath bathtub in a temperature-data recording section. In a control-information storing section, control information is stored for changing the contents of a setting in air-conditioning equipment provided in a place different from the bathroom. Then, using the period of time when the user has stayed in the bathroom, the period of time when the user has stayed in the bathtub, the temporal change in the temperature of the bathroom, the temporal change in the temperature of the bathtub, a predetermined numeric coefficient on the influence of the water inside of the bathtub on the human body, and a reference temperature that is a predetermined temperature which are recorded in the temperature-data recording section, an execution time to execute a control operation of the air-conditioning equipment is calculated based on the control information stored in the control-information storing section. Thereafter, operation data for operating the air-conditioning equipment during the calculated execution time is generated based on the control information stored in the control-information storing section. Then, the generated operation data is transmitted to the air-conditioning equipment. In a bathroom-state detecting section, the state of the user in the bathroom is detected, and the user information indicating the state of the user is transmitted to the control unit. Further, in a bathtub-state detecting section, the state of the user in the bathtub is detected, and the user information indicating the state of the user is transmitted to the control unit. In a bathroom-temperature detecting section, the temperature of the bathroom is detected, and the temperature data in the bathroom is transmitted to the control unit. Further, in a bathtub-temperature detecting section, the temperature of the bathtub is detected, and the temperature data in the bathtub is transmitted to the control unit. Still further, in the air-conditioning equipment, the operation data transmitted by the control unit is received, and an operation is executed according to the received operation data.

Therefore, in terms of the environment before the user moves to the place provided with the air-conditioning equipment, the fact that the user not only has stayed in the air but also has soaked in water (i.e., warm water) can be taken into account when the execution time for the air-conditioning equipment is calculated based on predetermined control information. Hence, a specialized system can be realized in a space like a bathroom which is a special environment where warm water as well as air exists together. This makes it possible to realize a more comfortable air-conditioning operation for the user.

According to the present invention, using the period of time when the user has stayed in the first area and the temperature of the first area, an execution time is calculated to execute a control operation of the air-conditioning equipment disposed in the second area based on the control information stored in the control-information storing section. Therefore, the user's environment before entering a room with the air-conditioning equipment is estimated based on time and temperature. Then, a result obtained from the estimation is reflected in the control of the air-conditioning equipment. This helps offer a more comfortable space to the user.

The objects, characteristics and advantages of the present invention will be more obvious in the following detailed description and attached drawings.

BRIEF DESCRIPTION OF THE DRAWINGS

FIG. 3 is a table, showing an example of data on a bathing time, a bathroom temperature change and a reference temperature.

FIG. 9 is a table, showing an example of a clothes-changing room presence time, a clothes-changing room temperature change and the difference in temperature between the bathroom and the clothes-changing room.

FIG. 12 is a table, showing an example of the correspondence of the relation between a point P and a point F stored in advance in a special-mode time calculation section to a change in the strength of $\Delta Ti$ according to the fourth embodiment of the present invention.

BEST MODE FOR IMPLEMENTING THE INVENTION

Hereinafter, embodiments of the present invention will be described with reference to the attached drawings.

First Embodiment

Figure 1:
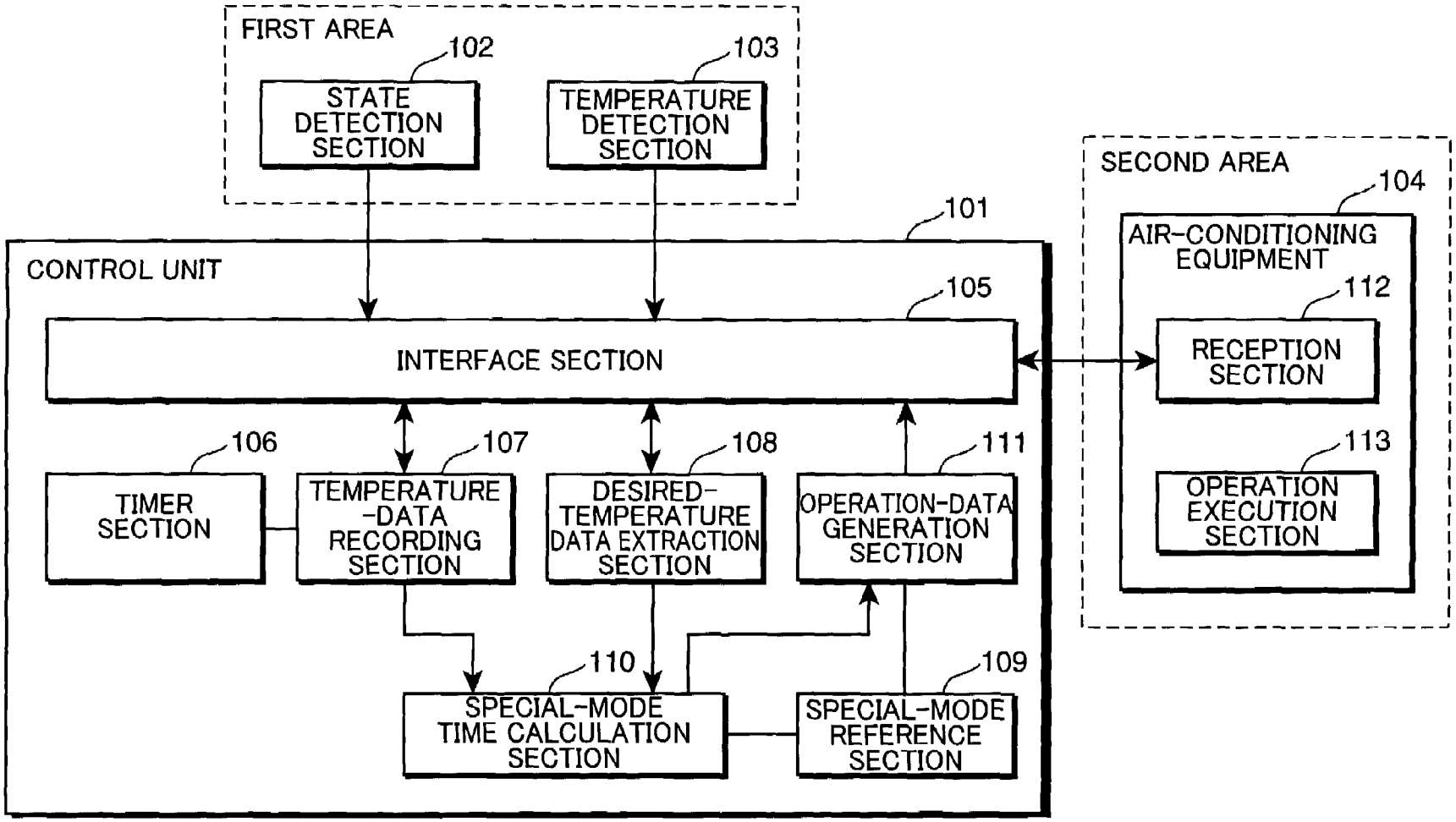
FIG. 1 is a block diagram, showing the configuration of a control system according to a first embodiment of the present invention.

FIG. 1 is a block diagram, showing the configuration of a control system according to a first embodiment of the present invention.

In FIG. 1, a control system is configured by a control unit 101, a state detection section 102, a temperature detection section 103, and air-conditioning equipment 104. On the basis of a period of time when a user has stayed in a first area and a temperature in the first area, the control unit 101 generates and outputs data on the operation of the indoor air-conditioning equipment 104. The first area is an area (or room) in which the user has stayed for a certain period before entering a second area (or room) provided with the air-conditioning equipment 104. The state detection section 102 detects a state of the user in the first area and transmits information indicating the user's state to the control unit 101. The temperature detection section 103 detects a temperature in the first area and transmits data on this temperature to the control unit 101. The air-conditioning equipment 104 conditions the air inside of the second area.

The control unit 101 is formed by an interface section 105, a timer section 106, a temperature-data recording section 107, a desired-temperature data extraction section 108, a special-mode reference section 109, a special-mode time calculation section 110, and an operation-data generation section 111. The interface section 105 is communicably connected to the state detection section 102, the temperature detection section 103 and the air-conditioning equipment 104. It receives data from the state detection section 102, the temperature detection section 103 and the air-conditioning equipment 104 and transmits data to the air-conditioning equipment 104. The timer section 106 clocks a period of time when the user has stayed in the first area.

The temperature-data recording section 107 records the period of time when the user has stayed in the first area which is clocked by the timer section 106. It also relates temperature data which it has received via the interface section 105 from the temperature detection section 103 to the period of time clocked by the timer section 106. Then, it records this temperature data as a temporal change in the temperature of the first area where the user has stayed before entering there, or as a temporal history. The temperature-data recording section 107 outputs, to the special-mode time calculation section 110, the period of time when the user has stayed in the first area clocked by the timer section 106 and this temporal change in the temperature.

The desired-temperature data extraction section 108 extracts a temperature which the user desires. In the special-mode reference section 109, control information is stored on a special mode where at least one of a set room temperature, a set air volume, a set diffused-air temperature and the like in the air-conditioning equipment 104 is each changed by a predetermined quantity. The special-mode time calculation section 110 calculates an execution time for the air-conditioning equipment 104 to execute an operation in the special mode, on the basis of the period of time when the user has stayed in the first area, the temporal change in the temperature of the first area and a reference temperature which is a fixed temperature which are outputted from the temperature-data recording section 107. The special-mode time calculation section 110 outputs this execution time to the operation-data generation section 111. The operation-data generation section 111 generates operation data for operating the air-conditioning equipment 104 on the basis of the control information in the special mode stored in the special-mode reference section 109 during the execution time to execute an operation in the special mode which is outputted from the special-mode time calculation section 110. The operation-data generation section 111 transmits the operation data via the interface section 105 to the air-conditioning equipment 104.

The state detection section 102 detects the fact that the user has stayed in the first area and detects the fact that the user is not staying in the first area. Then, it transmits user information for reporting those facts to the control unit 101.

In the interface section 105, data may be transmitted and received on the Internet. However, a radio or wired home communication network is used here.

The air-conditioning equipment 104 is formed by a reception section 112 and an operation execution section 113. The reception section 112 receives the operation data transmitted by the control unit 101. The operation execution section 113 executes an air-conditioning operation according to the operation data received by the reception section 112. The operation execution section 113 executes an air-conditioning operation based on the contents of a setting which the user inputs using a manipulation section (not shown).

In this embodiment, the interface section 105 corresponds to an example of the receiving section; the timer section 106, to an example of the clocking section; the temperature-data recording section 107, to an example of the temperature-data recording section; the special-mode reference section 109, to an example of the control-information storing section; the special-mode time calculation section 110, to an example of the execution-time calculating section; the operation-data generation section 111, to an example of the operation-data generating section; the desired-temperature data extraction section 108, to an example of the desired-temperature data extracting section; and the interface section 105, to an example of the operation-data transmitting section. In addition, the state detection section 102 corresponds to an example of the state detecting section, and the temperature detection section 103 corresponds to an example of the temperature detecting section. Furthermore, the reception section 112 corresponds to an example of the operation-data receiving section, and the operation execution section 113 corresponds to an example of the operation executing section.

Upon receiving information indicating that the user stays in the first area via the interface section 105 from the state detection section 102, the temperature-data recording section 107 prompts the timer section 106 to start clocking a time. Then, the temperature-data recording section 107 receives a temperature which is detected by the temperature detection section 103, at regular intervals or continuously through the interface section 105. It records them as a temporal change in the temperature. Thereafter, on receiving information indicating that the user is not staying in the first area via the interface section 105 from the state detection section 102, the temperature-data recording section 107 stops recording the temporal change in the temperature. Then, it stops the timer section 106 from clocking the time and outputs, to the special-mode time calculation section 110, the time clocked by the timer section 106 at this time and the temporal change in the temperature which it has recorded so far.

On the other hand, the desired-temperature data extraction section 108 extracts a temperature desired by the user as a reference temperature used when the special-mode time calculation section 110 calculates an execution time to execute an operation in a special mode. Herein, it acquires, through the interface section 105, for example, a room temperature in the air-conditioning equipment 104 which is optionally set by the user. Upon acquiring the set room temperature as the temperature desired by the user from the air-conditioning equipment 104, the desired-temperature data extraction section 108 outputs it to the special-mode time calculation section 110. At this time, the desired-temperature data extraction section 108 may also periodically receive a set room temperature beforehand from the air-conditioning equipment 104. In that case, it outputs their average temperature as the temperature desired by the user.

In the special-mode time calculation section 110, the temporal change in the temperature of the first area where the user has stayed before entering there and the period of time when the user has stayed in the first area which is clocked by the timer section 106 are inputted from the temperature-data recording section 107. Using the temperature desired by the user as the reference temperature which is inputted from the desired-temperature data extraction section 108, as well as the temporal change in the temperature and the period of time which are inputted, the special-mode time calculation section 110 calculates an execution time to execute an operation in a special mode in the air-conditioning equipment 104. Then, it outputs this execution time to the operation-data generation section 111.

Upon receiving an input of the execution time to execute an operation in a special mode from the special-mode time calculation section 110, the operation-data generation section 111 refers to a setting of the special mode stored in the special-mode reference section 109. Then, it generates operation data for executing this setting for the execution time inputted from the special-mode time calculation section 110 and transmits it via the interface section 105 to the air-conditioning equipment 104.

Herein, in the special-mode reference section 109, a value which is left after a set room temperature in the special mode is subtracted from a room temperature optionally set by the user is stored as an example of the special-mode setting. The operation-data generation section 111 refers to this value when generating the operation data in the air-conditioning equipment 104. Then, it generates operation data for executing an operation whose set room temperature is lowered by the value for the execution time inputted from the special-mode time calculation section 110.

Upon receiving the operation data which is an operation instruction from the control unit 101, the air-conditioning equipment 104 executes an operation according to the contents of this operation data.

In order to make the first embodiment of the present invention more clearly understandable, as an example, let's assume that a bathroom corresponds to the room (i.e., the first area) where the user has stayed before entering a room (i.e., the second area) provided with the air-conditioning equipment 104. In addition, the user's state detected by the state detection section 102 is assumed to be the user's bathing start and bathing end, and the temperature detected by the temperature detection section 103 is assumed to be a temperature inside of the bathroom. Furthermore, let's call the special-mode operation in the air-conditioning equipment 104 a cooling-down mode air-conditioning. Hereinafter, a specific description will be given thereof.

In the state detection section 102, the user's bathing start and bathing end are detected, for example, based on whether the bathroom's lights are turned on or off, whether a human-body detecting sensor detects the user being staying or not in the bathroom, or another such. Herein, the state detection section 102 is designed as a bathroom presence-and-absence sensor.

Figure 2:
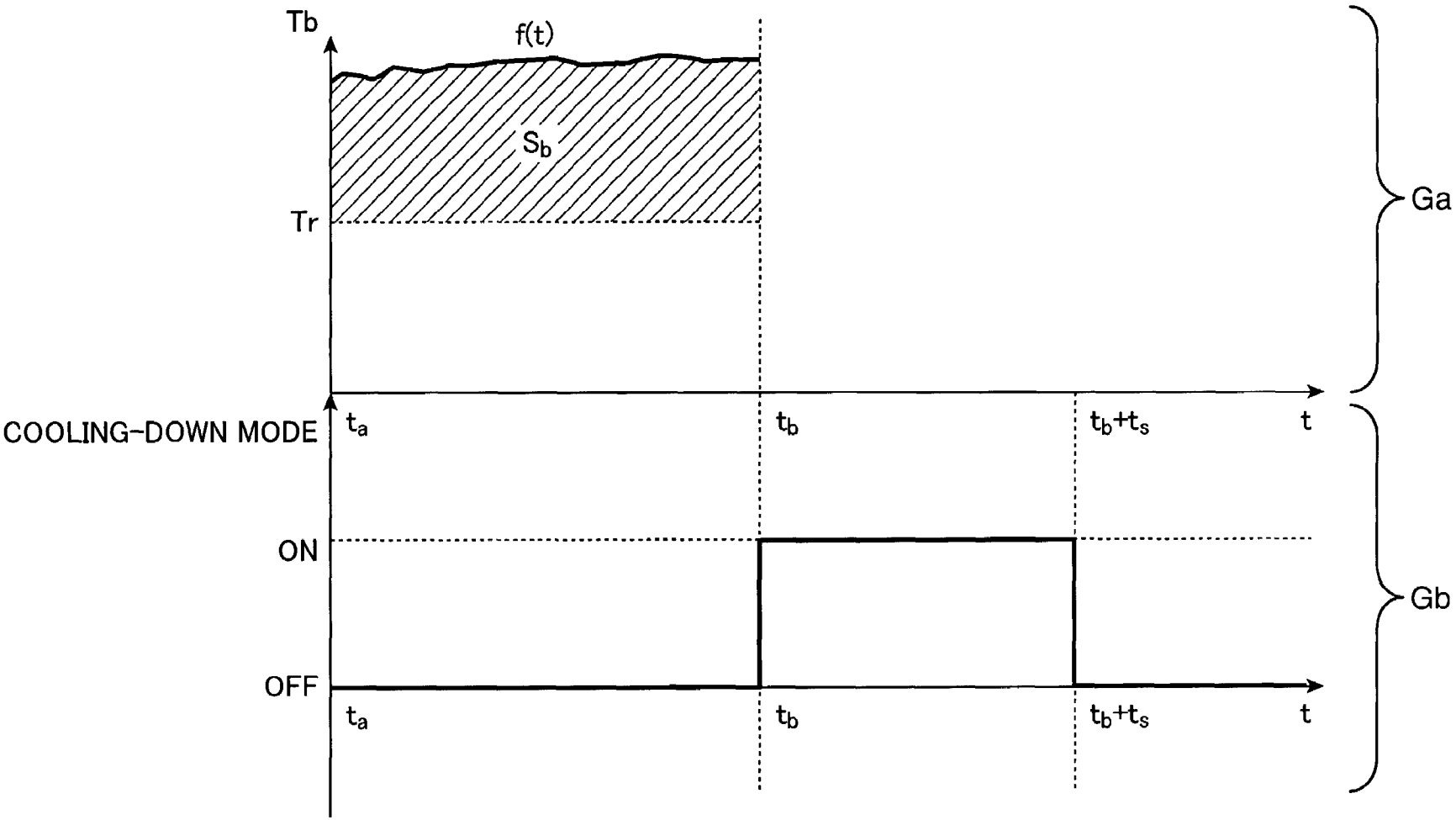
FIG. 2 is a graphical representation, showing the relation between an example of a temporal change in the temperature of a bathroom and information transmitted by a control unit according to the first embodiment of the present invention.

FIG. 2 is a graphical representation, showing the relation between an example of a temporal change in the temperature inside of the bathroom and information transmitted by the control unit 101 according to the first embodiment of the present invention.

In a graph Ga of FIG. 2, the vertical axis Tb represents the bathroom's temperature detected by the temperature detection section 103. Reference character Tr denotes a temperature (i.e., the reference temperature) desired by the user which is extracted in the desired-temperature data extraction section 108. Reference characters ta and tb on the horizontal axis designate a bathing-start time and a bathing-end time which are clocked in the timer section 106, respectively. Reference character f(t) denotes a function indicating a temporal change in the bathroom temperature. In a graph Gb of FIG. 2, the vertical axis represents the on/off of a signal at the time of the cooling-down mode air-conditioning. In the same way as the graph Ga, reference characters ta and tb on the horizontal axis designate a bathing-start time and a bathing-end time which are clocked in the timer section 106. Reference character ts denotes an execution time for the cooling-down mode air-conditioning.

In the special-mode time calculation section 110 of the control unit 101, how to calculate the execution time ts for the air-conditioning equipment 104 to execute the cooling-down mode air-conditioning will be described below.

The execution time ts for the cooling-down mode air-conditioning is calculated based on the user's bathing time (tb−ta) and the temporal change f(t) in the bathroom temperature which are inputted from the temperature-data recording section 107 and the temperature Tr desired by the user which is inputted from the desired-temperature data extraction section 108. Herein, it is calculated using the following expressions (1) to (3).

$$Sb=\int_{ta}^{tb}(f(t)-Tr)dt \quad (1)$$

$$ts=\alpha\cdot Sb \quad (2)$$

In this expression (1), Sb is an integral equation which is composed of the temporal change f(t) in the bathroom temperature and the temperature Tr desired by the user which is the reference temperature. It is equivalent to the area of the hatched part of FIG. 2. As shown in the above described expression (2), Sb multiplied by a coefficient α is the execution time ts for the cooling-down mode air-conditioning.

Herein, the coefficient α is calculated using the following expression (3).

$$\alpha=\beta/\Delta Ti \quad (3)$$

In this expression (3), β is, for example, a coefficient given in advance from the result of a subject experiment or the like. ΔTi is a value which is obtained by subtracting the set room temperature in the cooling-down mode air-conditioning from the room temperature optionally set by the user. It is also registered in the special-mode reference section 109. Hence, the above described coefficient α is a coefficient correlative to the temperature difference ΔTi. The greater the value ΔTi becomes, the smaller the value α will be (e.g., they are inversely proportional to each other).

The coefficient α may also be calculated using the following expression (4).

$$\alpha=\alpha 0\cdot Tr0/Tr \quad (4)$$

For example, α0 is a coefficient given in advance from the result of a subject experiment or the like. Tr0 is a reference temperature given in advance as a general optimum temperature from the result of a subject experiment or the like. Tr is a temperature desired by the user which is the reference temperature. Hence, the above described coefficient α is a coefficient correlative to the user-desired temperature Tr. As the temperature Tr becomes lower than the temperature Tr0, the value α will be greater than the value α0 (e.g., they are inversely proportional to each other).

FIG. 3 is a table, showing an example of data on a bathing time, a bathroom temperature change and a reference temperature. In the table of FIG. 3, for example, the user's bathing time is 25 minutes. The bathroom temperature changes from 30° C. at the time when the user comes into the bathroom to 32° C. at the time when the user leaves it. The reference temperature is 26° C. Hereinafter, a specific description will be given using the data example shown in FIG. 3.

Figure 4:
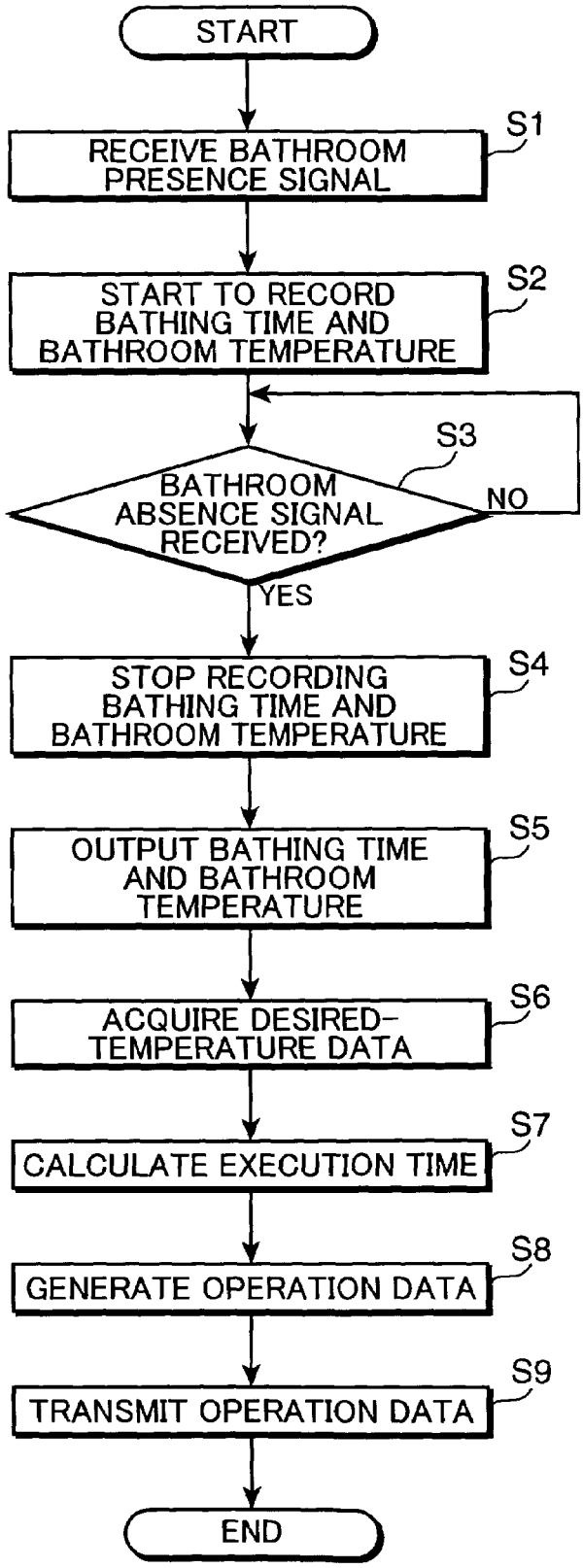
FIG. 4 is a flow chart, showing the process of the control unit outputting data on the operation of air-conditioning equipment according to the first embodiment of the present invention.

FIG. 4 is a flow chart, showing the process of the control unit 101 outputting data on the operation of air-conditioning equipment 104 according to the first embodiment of the present invention.

In FIG. 4, first, the interface section 105 receives a bathroom presence signal indicating that the user is staying in the bathroom from the state detection section (i.e., the bathroom presence-and-absence sensor) 102 (in a step S1). The interface section 105 outputs this bathroom presence signal to the temperature-data recording section 107. Next, on receiving an input of the bathroom presence signal, the temperature-data recording section 107 prompts the timer section 106 to start clocking the bathing time. Then, it acquires, via the interface section 105, a bathroom temperature which is detected by the temperature detection section 103. Herein, from the point of the bathroom temperature 30° C. detected by the temperature detection section 103, the temperature-data recording section 107 receives a bathroom temperature at regular intervals through the interface section 105. Then, it continues to record them as a temporal change in the bathroom temperature until receiving a bathroom absence signal from the bathroom presence-and-absence sensor 102 (in a step S2).

Next, the temperature-data recording section 107 decides whether it has received the bathroom absence signal indicating that the user is not staying in the bathroom (in a step S3). If it decides that it has not received the bathroom absence signal (NO at the step S3), it makes a decision repeatedly at regular intervals until receiving the bathroom absence signal. On the other hand, if it decides that it has received the bathroom absence signal (YES at the step S3), the processing shifts to a step S4.

After receiving the bathroom presence signal via the interface section 105 from the bathroom presence-and-absence sensor 102, the temperature-data recording section 107 receives the bathroom absence signal through the interface section 105 (YES at the step S3). Then, it records the bathroom temperature 32° C. at this time for the last time. Sequentially, it stops the timer section 106 from clocking the bathing time and stops recording a temporal change in the bathroom temperature (in the step S4). Next, the temperature-data recording section 107 outputs the bathing time clocked by the timer section 106 and the temporal change in the bathroom temperature to the special-mode time calculation section 110 (in a step S5). The period of time when the user has stayed in the bathroom (i.e., the clocked period of time from the reception of the bathroom presence signal to the reception of the bathroom absence signal) is regarded as the bathing time. Assuming the bathing time to be 25 minutes, the temperature-data recording section 107 outputs, to the special-mode time calculation section 110, the bathing time of 25 minutes and the temporal change in the bathroom temperature obtained by continuing to record it for 25 minutes.

Next, the desired-temperature data extraction section 108 receives a room temperature set in the air-conditioning equipment 104 via the interface section 105. Then, it outputs this set room temperature as the temperature desired by the user to the special-mode time calculation section 110 (in a step S6). Herein, the desired-temperature data extraction section 108 acquires the set room temperature which is, for example, 26° C. Specifically, the desired-temperature data extraction section 108 transmits a request signal for requesting a set room temperature to the air-conditioning equipment 104. Upon receiving the request signal, the air-conditioning equipment 104 reads a set room temperature stored inside and transmits it to the control unit 101. The interface section 105 receives the set room temperature transmitted by the air-conditioning equipment 104 and outputs it to the desired-temperature data extraction section 108. In this way, the desired-temperature data extraction section 108 acquires the set room temperature from the air-conditioning equipment 104.

Next, in the special-mode time calculation section 110, the user-desired temperature 26° C. is inputted from the desired-temperature data extraction section 108 and the bathing time of 25 minutes and the temporal change in the bathroom temperature are inputted from the temperature-data recording section 107. Then, it calculates the coefficient $\alpha$, using the above described expression (3) or (4). Herein, the coefficient $\alpha$ is calculated, for example, by setting the temperature difference $\Delta Ti$ to 4° C. The temperature difference $\Delta Ti$ is stored in the special-mode reference section 109, by which the set room temperature should be lowered from the room temperature of the air-conditioning equipment 104 optionally set by the user. Or, the coefficient $\alpha$ is calculated, for example, by setting the reference temperature Tr0 given beforehand as a general optimum temperature to 28° C. After calculating the coefficient $\alpha$, the special-mode time calculation section 110 assigns, to the above described expressions (1) and (2), the function f(t) indicating the temporal change from 30° C. to 32° C. in the bathroom temperature, the bathing time of 25 minutes, the user-desired temperature 26° C. and the coefficient $\alpha$ calculated using the above described expression (3) or (4). Thereby, it calculates the execution time ts for the cooling-down mode air-conditioning in the air-conditioning equipment 104. Then, the special-mode time calculation section 110 outputs this execution time ts to the operation-data generation section 111 (in a step S7).

Next, upon receiving an input of the execution time ts for the cooling-down mode air-conditioning from the special-mode time calculation section 110, the operation-data generation section 111 refers to the setting of the cooling-down mode air-conditioning for lowering the set room temperature by 4° C. from the room temperature optionally set by the user. This setting is stored in the special-mode reference section 109. Then, the operation-data generation section 111 generates operation data for executing the cooling-down mode air-conditioning stored in the special-mode reference section 109 for the execution time ts inputted from the special-mode time calculation section 110 (in a step S8). Sequentially, the operation-data generation section 111 transmits the operation data via the interface section 105 to the air-conditioning equipment 104 (in a step S9).

After receiving the operation data from the control unit 101, according to this operation data, the air-conditioning equipment 104 executes control so as to execute the cooling-down mode air-conditioning for the execution time ts.

In this way, user information indicating the state of a user in a first area and temperature data in the first area are received. Based on the received user information, a period of time when the user has stayed in the first area is clocked. Then, the clocked period of time when the user has stayed in the first area is recorded, and by relating the received temperature data to this period of time, this temperature data is recorded as a temporal change in the temperature of the first area in the temperature-data recording section 107. In the special-mode reference section 109, control information is stored for changing the contents of a setting in the air-conditioning equipment 104 provided in a second area different from the first area. Using the period of time when the user has stayed in the first area, the temporal change in the temperature and a reference temperature that is a predetermined temperature which are recorded in the temperature-data recording section 107, an execution time to execute a control operation of the air-conditioning equipment is calculated based on the control information stored in the special-mode reference section 109. Operation data for operating the air-conditioning equipment 104 during the calculated execution time is generated based on the control information stored in the special-mode reference section 109.

Accordingly, using the period of time when the user has stayed in the first area and the temperature of the first area, an execution time is calculated to execute a control operation of the air-conditioning equipment 104 disposed in the second area based on the control information stored in the special-mode reference section 109. Therefore, the user's environment before entering a room with the air-conditioning equipment 104 is estimated based on time and temperature. Then, a result obtained from the estimation is reflected in the control of the air-conditioning equipment 104. This helps offer a more comfortable space to the user.

Conventionally, a user cancels a special mode, for example, after feeling chilly and uncomfortable. In contrast, according to this embodiment, the control unit 101 cancels the special mode automatically so that the user's desire is reflected. Therefore, first, the user can feel comfortable from an operation in the special mode shortly after coming into the room. Sequentially, while the special-mode operation is executed, for example, the user can escape being given an uncomfortable feeling of the cold or the like. This helps offer the user a space which is more healthful and comfortable, and is formed by taking into account personal differences in thermal sensation. Besides, there is no need to directly detect information on the user's body, such as a body temperature which is not supposed to be daily taken. Hence, this embodiment can be realized, using air temperature or time which is routinely taken or clocked easily without asking for a person's help. Therefore, compared with any prior art, it has extremely great practicality and feasibility, and it can be realized at a low cost.

Furthermore, the user information includes information for detecting whether the user is present or absent in the first area. Therefore, the fact that the user is present in the first area can be certainly confirmed. This makes it possible to precisely calculate an execution time to execute control of the air-conditioning equipment 104 based on predetermined control information.

Moreover, using the period of time when the user has stayed in the first area, the temperature of the first area, as well as the user-desired temperature, an execution time is calculated to execute control of the air-conditioning equipment 104 disposed in the second area based on predetermined control information. Therefore, the user-desired temperature can be reflected in the control of the air-conditioning equipment 104. This helps execute its operation, taking into account the difference in thermal sensation between users.

In addition, as the user-desired temperature, a room temperature which is optionally set by the user is used in the air-conditioning equipment 104. Therefore, the user-desired temperature can be automatically extracted more easily than any other method, such as the user's voice statement and the analysis of the temperature at which the user daily feels comfortable by detecting information on the user's body.

Furthermore, in this embodiment, in terms of the cooling-down mode air-conditioning, the set temperature is lowered by the value ΔTi from a room temperature which is optionally set by the user, and then, the operation is executed. However, the air volume may also be increased by a value ΔVi from an air volume which is set by the user. Or, the diffused-air temperature may also be lowered by a value ΔTi from a diffused-air temperature which is set by the user.

Moreover, in this embodiment, a bathroom temperature and a bathing time are used to calculate the execution time ts for the cooling-down mode air-conditioning. However, a section may also be used for detecting the temperature of warm water in a bathtub and a period of time when the user has soaked in the warm water. In that case, it is calculated using the warm-water temperature and the period of time when the user has soaked in the bathtub.

In addition, in this embodiment, the environment in which the user stays before entering the room is a bathroom. However, it is not limited to this, and thus, another environment can also be applied. For example, while the user is out, a global positioning system (or GPS) mounted in a portable remote terminal may also detect the user staying outdoors. Then, the portable remote terminal takes and clocks the air temperature and the period of time when the user is out. When the user comes home, such data is transmitted through a battery charger or the like to the control unit 101. Besides, a sensor which detects the user going out and coming home may also be provided at an automobile door, the front door of a house, or the like. Then, this sensor detects the user staying outdoors. In this case, the sensor transmits information indicating that the user is outdoors to the portable remote terminal. Upon receiving the information indicating that the user is outdoors, the portable remote terminal takes and clocks the air temperature and the period of time when the user is out. When the user comes home, the sensor transmits information indicating that the user has come home to the portable remote terminal. Upon receiving the information indicating that the user has come home, the portable remote terminal stops taking and clocking the air temperature and the period of time when the user is out. Thereafter, the portable remote terminal is set in a battery charger or the like, and then, such data is transmitted through the battery charger or the like to the control unit 101.

Still further, in this embodiment, the environment in which the user stays before entering the room is a bathroom, and a bathroom temperature and a bathing time are detected, and after coming into the room, an execution time to execute the special-mode operation in the air-conditioning equipment 104 is determined. However, which room the user stays in before entering the room, and how the environment under which the user stays there is, may also be detected. Then, after coming into the room, an execution time to execute the special-mode operation in the air-conditioning equipment 104 is determined.

Moreover, in this embodiment, the coefficient α does not include information on conditions for a room (e.g., the room's size) provided with the air-conditioning equipment 104. However, the coefficient α may also include data on such room conditions. In that case, the execution time ts for the cooling-down mode air-conditioning is corrected so as to match with such information. Thereby, an environment which the control unit 101 aims to realize can be accurately achieved.

Furthermore, in this embodiment, the execution time for the cooling-down mode air-conditioning is calculated, using a bathing time, a temporal change in a bathroom temperature and a temperature desired by the user. In addition to these, it may also calculated, using information on the user's body, such as a heartbeat and a pulse wave.

Second Embodiment

In a second embodiment of the present invention, similarly to the first embodiment, as an example, let's assume that a bathroom corresponds to an environment (i.e., the first area) where the user has stayed before entering a room (i.e., the second area) provided with the air-conditioning equipment 104. The state detection section 102 is assumed to be a bathroom presence-and-absence sensor, and the temperature detected by the temperature detection section 103 is assumed to be a bathroom temperature. Furthermore, let's call the special-mode operation in the air-conditioning equipment 104 a cooling-down mode air-conditioning. Hereinafter, a specific description will be given thereof.

Similarly to the first embodiment, in the control unit 101, the special-mode time calculation section 110 calculates the execution time ts to execute the cooling-down mode air-conditioning in the air-conditioning equipment 104. It is different from the first embodiment, in the following respect. If the user's bathing time inputted from the temperature-data recording section 107 exceeds a fixed time, the special-mode time calculation section 110 sets the temporal change f(t) in the bathroom temperature used to calculate the execution time ts for the cooling-down mode air-conditioning, not to a temporal change in the bathroom temperature for the whole bathing time, but to a temporal change in the bathroom temperature within a time range (hereinafter, referred to as the specific time) defined in advance during the bathing time.

Figure 5A:
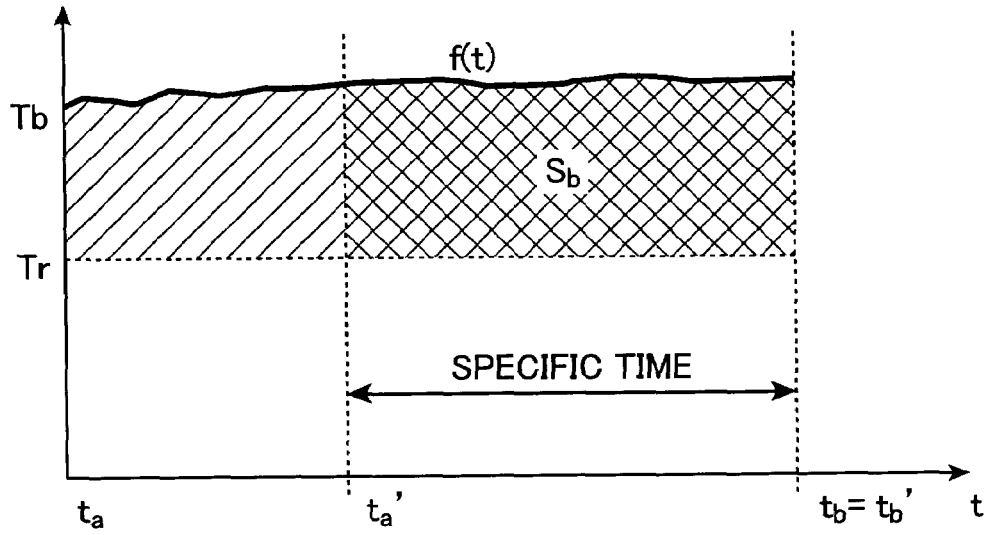
FIG. 5A is a graphical representation, showing an example of a temporal change in the bathroom temperature within a specific time.
Figure 5B:
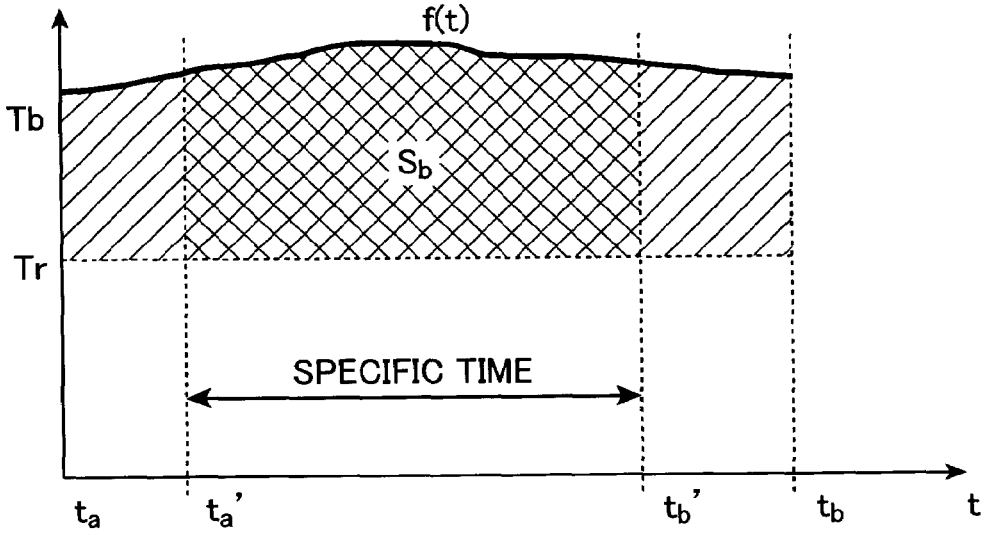
FIG. 5B is a graphical representation, showing another example of the temporal change in the bathroom temperature within the specific time.

FIG. 5 is graphical representations, each showing an example of a temporal change in the bathroom temperature according to the second embodiment of the present invention. FIG. 5A is a graphical representation, showing an example of a temporal change in the bathroom temperature within the specific time. FIG. 5B is a graphical representation, showing another example of the temporal change in the bathroom temperature within the specific time.

In the same way as the first embodiment, the vertical axis Tb represents the bathroom's temperature detected by the temperature detection section 103. Reference character Tr denotes a user-desired temperature which is used as the reference temperature and is extracted by the desired-temperature data extraction section 108. Reference characters ta and tb on the horizontal axis designate a bathing-start time and a bathing-end time which are clocked in the timer section 106, respectively. Reference character f(t) denotes a function indicating a temporal change in the bathroom temperature.

First, in FIG. 5A, if the user's bathing time inputted from the temperature-data recording section 107 has exceeded the specific time, then in terms of the temporal change f(t) in the bathroom temperature during the bathing time, using the temporal change f(t) in the bathroom temperature within the range from a point of time ta' which goes back by the specific time from the bathing-end time tb to the bathing-end time tb, the special-mode time calculation section 110 calculates the execution time ts in the same way as the first embodiment. Herein, an end point tb' of the specific-time range coincides with the bathing-end time tb.

On the other hand, in FIG. 5B, if the user's bathing time inputted from the temperature-data recording section 107 has exceeded the specific time, the special-mode time calculation section 110 detects the point of time when the highest temperature is recorded on the temporal change f(t) in the bathroom temperature during the bathing time. Then, similarly to the first embodiment, the special-mode time calculation section 110 calculates the execution time ts, using the temporal change f(t) in the bathroom temperature within the range from the point ta' to the point tb' which continues for the specific time so that its middle becomes the highest-temperature record point.

Incidentally, in this embodiment, the execution time is calculated, using the temporal change f(t) in the bathroom temperature within the time range which continues for the specific time so that its middle becomes the highest-temperature record point. However, the present invention is not limited especially to this. The execution time may also be calculated, using the temporal change f(t) in the bathroom temperature within the time range which includes the highest-temperature record point and continues for the specific time.

Therefore, in the case where the user's bathing time inputted from the temperature-data recording section 107 exceeds the specific time, the execution time ts for the cooling-down mode air-conditioning may also be calculated, using either of the above described two methods. Herein, using the method of FIG. 5A, the case where the specific time is 30 minutes and the user's bathing time is 45 minutes will be described below, using a data example similar to the first embodiment.

Figure 6:
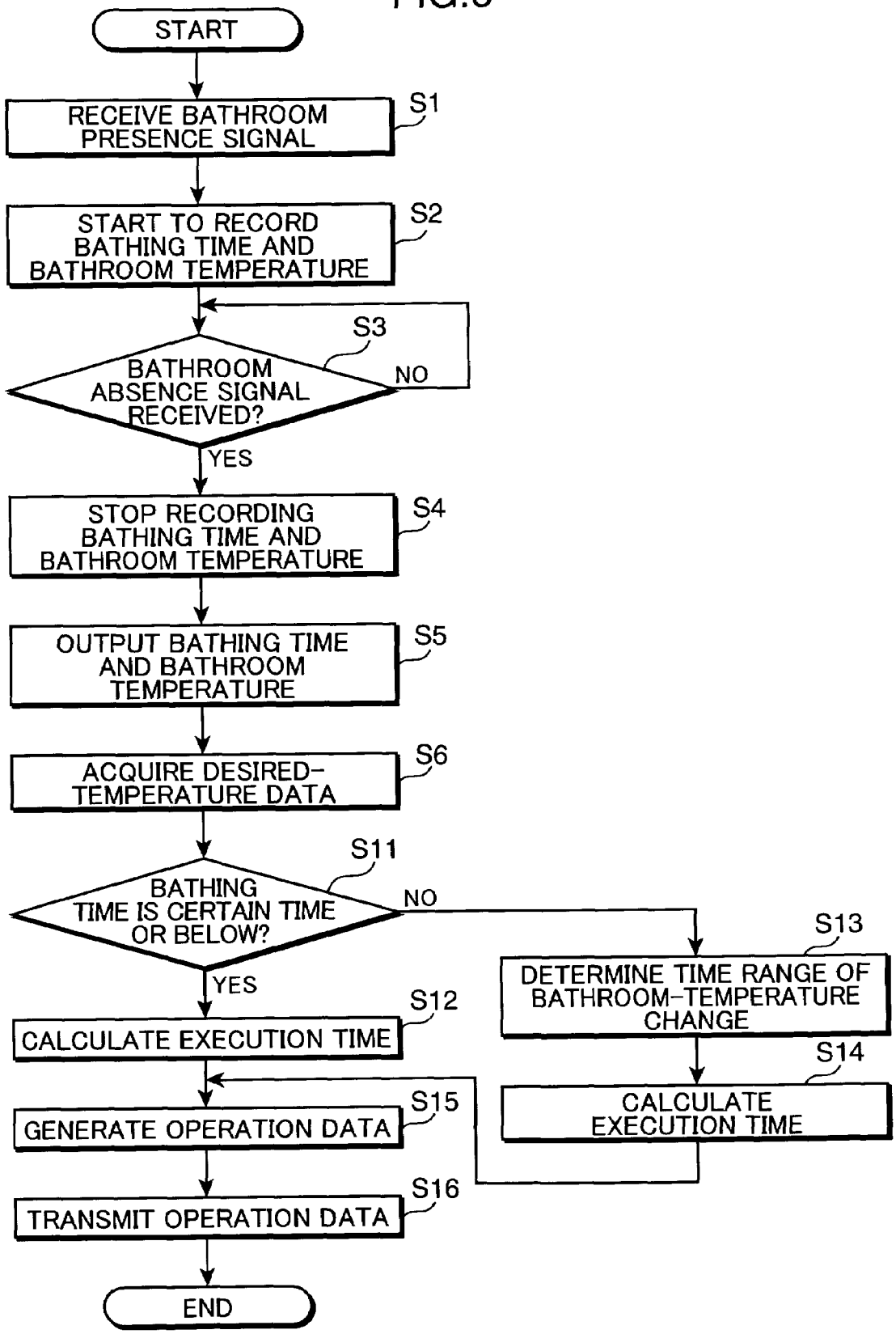
FIG. 6 is a flow chart, showing the process of a control unit outputting data on the operation of air-conditioning equipment according to a second embodiment of the present invention.

FIG. 6 is a flow chart, showing the process of the control unit 101 outputting operation data of the air-conditioning equipment 104 according to the second embodiment of the present invention.

In FIG. 6, the control unit 101's processing (i.e., the processing from a step S1 to a step S6) from the reception of a bathroom presence signal from the bathroom presence-and-absence sensor 102 to the output of a temperature desired by the user from the desired-temperature data extraction section 108 is the same as the processing of the first embodiment shown in FIG. 4. Hence, each step is given the same reference character and numeral, and thus, their description is omitted.

Upon receiving a temporal change in the bathroom temperature and data indicating that the user's bathing time is 45 minutes from the temperature-data recording section 107, the special-mode time calculation section 110 decides whether or not the bathing time is equal to, or shorter than, a fixed time (in a step S11). In this embodiment, the specific time is preset at 30 minutes, and thus, the special-mode time calculation section 110 decides whether or not the bathing time is equal to, or shorter than, 30 minutes. If the decision is made that the bathing time is equal to, or shorter than, the fixed time (YES at the step S11), the processing goes ahead to a step S12.

On the other hand, if the decision is made that the bathing time is longer than the fixed time (NO at the step S11), the special-mode time calculation section 110 determines the time range of the temporal change in the bathroom temperature (in a step S13). In this embodiment, the bathing time is 45 minutes, and thus, it is longer than the fixed time of 30 minutes. Hence, the time range of the temporal change in the bathroom temperature is from the point of time (corresponding to ta' of FIG. 5A) which goes back by 30 minutes from the bathing-end time of 45 minutes, or when 15 minutes have elapsed since the bathing began, until the bathing-end time tb. Next, the special-mode time calculation section 110 calculates the execution time ts for the cooling-down mode air-conditioning, using an expression (5) whose integral range is equivalent to the time range from the point of time ta' when 15 minutes have passed since the bathing start to the bathing-end time tb and an expression (6) described below (in a step S14). Herein, the coefficient α is calculated in the same way as the first embodiment.

$$Sb=\int_{ta'}^{tb}(f(t)-Tr)dt \tag{5}$$

$$ts=\alpha\cdot Sb \tag{6}$$

Next, after calculating the execution time ts for the cooling-down mode air-conditioning, the special-mode time calculation section 110 outputs this execution time ts to the operation-data generation section 111. The processing of the step S12, the step S15 and the step S16 is the same as the processing of the step S7, the step S8 and the step S9 shown in FIG. 4, and thus, their description is omitted.

As described so far, during the period of time when the user has stayed in the first area before entering a room provided with the air-conditioning equipment 104, using a temperature change for a preset specific time, an execution time is calculated to execute a special-mode operation in the air-conditioning equipment 104. Therefore, even if the user spends a long time in the first area, the execution time to execute the special-mode operation in the air-conditioning equipment 104 can be prevented from being longer than necessary. Hence, the execution time can be set to a suitable time, thus realizing efficient air-conditioning control. Particularly, after feeling comfortable shortly after coming into the room, for example, the user can escape being given an uncomfortable feeling of a chill or the like. Also in the aspect of costs, efficient air-conditioning control can be realized.

Furthermore, as shown in FIG. 5A, during the period of time when the user has stayed in the first area before entering a room provided with the air-conditioning equipment 104, using a temperature change for the period of time which continues only for a specific time immediately before entering the room, an execution time is calculated to execute an operation in a special mode. Therefore, even if the user spends a long time in the first area, the user's state for the period of time which continues only for the specific time immediately before entering the room is reflected in the execution time to execute the special-mode operation. This makes it possible to realize more comfortable air-conditioning for the user.

Moreover, as shown in FIG. 5B, during the period of time when the user has stayed in the first area before entering a room provided with the air-conditioning equipment 104, using a temperature change for a specific time which includes the point of time when the maximum temperature or the minimum temperature is recorded, an execution time is calculated to execute an operation in a special mode. Therefore, even if the user spends a long time in the first area, the user's state for the period of time which continues only for the specific time which includes the point of time when the user has stayed under the worst condition before entering the room is reflected in the execution time to execute the special-mode operation. This makes it possible to realize more comfortable air-conditioning for the user.

Incidentally, in this embodiment, the above description is given in the case where the temperature of the environment in which the user has stayed before entering a room provided with the air-conditioning equipment 104 is generally higher than the reference temperature Tr. However, the present invention can be applied, even if the former is lower than the latter. In that case, the special-mode time calculation section 110 may also calculate the execution time ts to execute a special-mode operation in the air-conditioning equipment 104, using the following expressions (7) and (8).

$$Sb=\int_{ta'}^{tb}(Tr-f(t))dt \tag{7}$$

$$ts=\alpha\cdot Sb \tag{8}$$

At this time, the special-mode operation in the air-conditioning equipment 104 may also be an operation for raising the set temperature by ΔTi from a room temperature optionally set by the user, an operation for increasing the air volume by ΔVi from an air volume set by the user, or an operation for heightening the diffused-air temperature by ΔTi from a diffused-air temperature set by the user.

In addition, in this embodiment, the special-mode time calculation section 110 extracts the point of time when the maximum temperature is recorded in the bathroom temperature detected by the temperature detection section 103. Thereby, it determines the time range used in the following expression (5). However, taking into account the case where the environment before the user enters the room is not a bathroom, the point of time when the minimum temperature is recorded may also be extracted. In other words, the point of time when the user's environment has come into its worst condition may also be extracted.

Third Embodiment

In a third embodiment of the present invention, in the same way as the first embodiment, as an example, let's assume that a bathroom corresponds to the first area where the user has stayed before entering a room (i.e., the second area) provided with the air-conditioning equipment 104. The state detection section 102 is assumed to be a bathroom presence-and-absence sensor, and the temperature detected by the temperature detection section 103 is assumed to be a bathroom temperature. Furthermore, let's call the special-mode operation in the air-conditioning equipment 104 a cooling-down mode air-conditioning. Hereinafter, a description will be given thereof.

In the third embodiment, the user is supposed to leave the bathroom as the first area, passes through a clothes-changing room corresponding to the third area and moves into the room as the second area provided with the air-conditioning equipment 104. Not only the environment in the bathroom as the first area, but also the environment in the clothes-changing room as an example of the third area, is reflected in the execution time for the cooling-down mode air-conditioning in the air-conditioning equipment 104 inside of the room as the second area. This is a different point from the first embodiment. In this embodiment, the clothes-changing room is described as an example of the third area, but the present invention is not limited especially to this. The third area is equivalent to at least one area where the user has stayed until moving into the room corresponding to the second area since leaving the first area.

Figure 7:
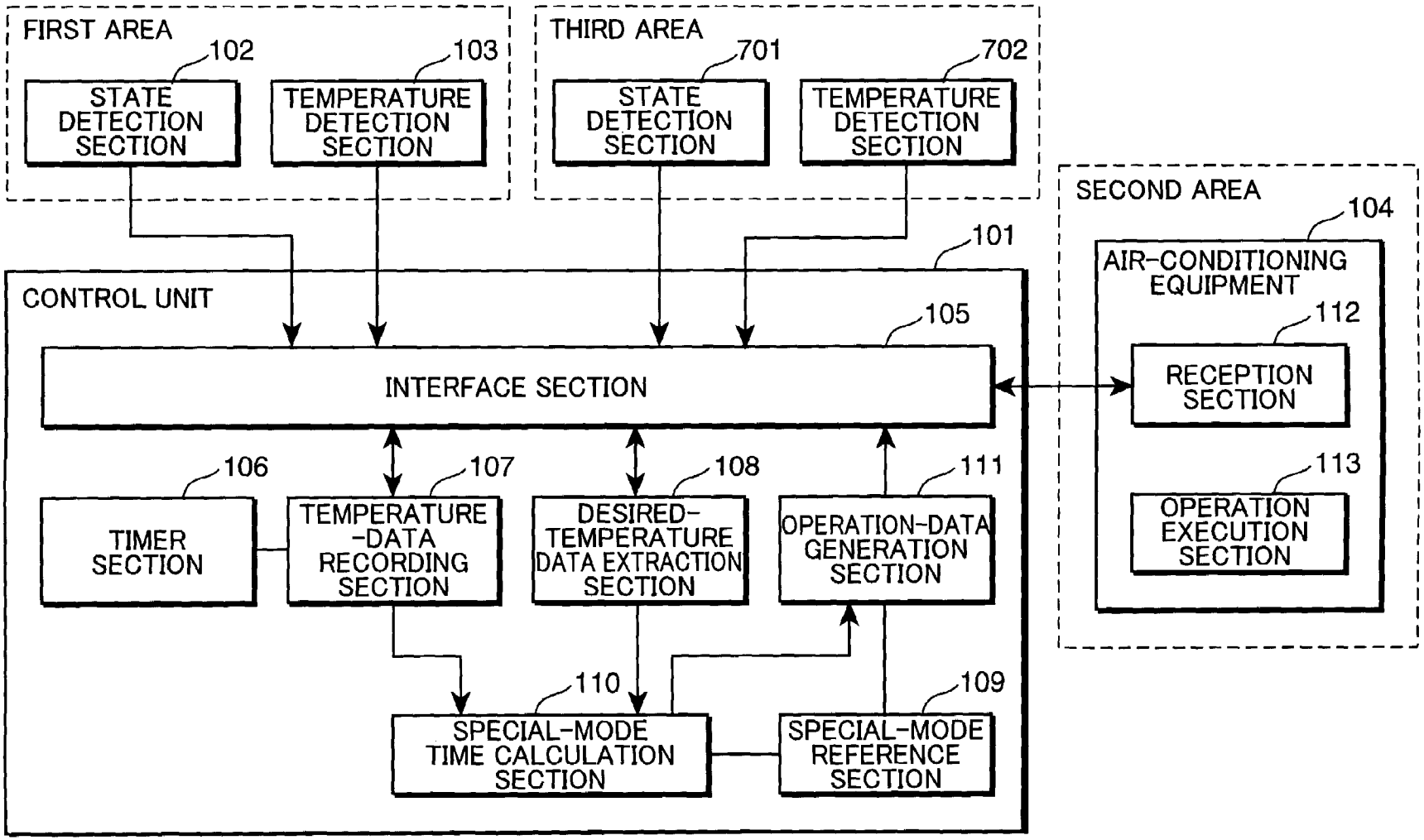
FIG. 7 is a block diagram, showing the configuration of a control system according to a third embodiment of the present invention.

FIG. 7 is a block diagram, showing the configuration of a control system according to the third embodiment of the present invention.

In FIG. 7, a control unit 101, a state detection section 102, a temperature detection section 103, air-conditioning equipment 104, an interface section 105, a timer section 106, a temperature-data recording section 107, a desired-temperature data extraction section 108, a special-mode reference section 109, a special-mode time calculation section 110, and an operation-data generation section 111 each have the same configuration as the identical component elements according to the first embodiment. Hence, their description is omitted. A state detection section 701 is provided in the clothes-changing room (i.e., the third area). It is a presence-and-absence sensor which detects the user staying in the clothes-changing room. A temperature detection section 702 is provided in the clothes-changing room (i.e., the third area) and detects the temperature of the clothes-changing room. The air-conditioning equipment 104 is provided, for example, in a living room (i.e., the second area).

The state detection section 701 detects the user staying in the clothes-changing room and the user not staying any longer in the clothes-changing room. Then, it transmits information for reporting those facts to the control unit 101.

The control unit 101 operates in the same way as the first embodiment until the user finishes taking a bath in the bathroom. Herein, its operation after the user has finished bathing and moved into the clothes-changing room will be described using a specific example.

Figure 8:
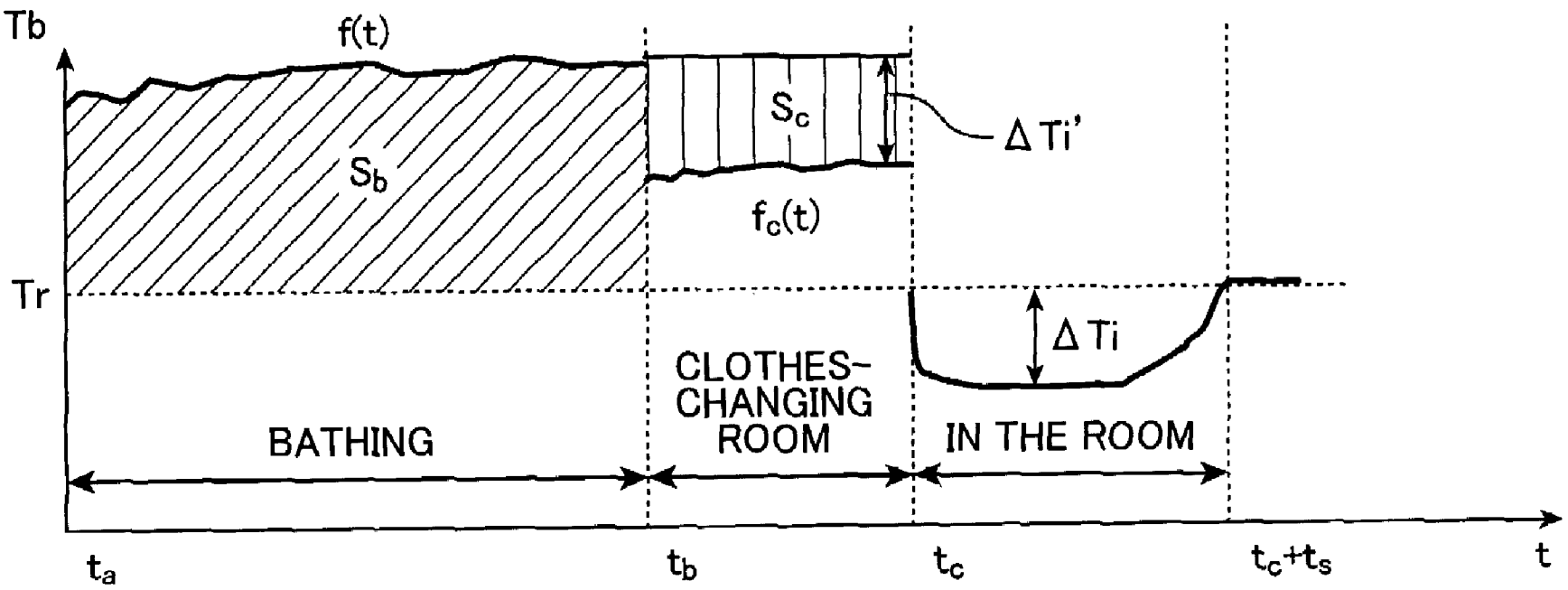
FIG. 8 is a graphical representation, showing the relation between an example of a temporal change in the temperature of a bathroom and a clothes-changing room and an example of a change in the set room temperature in a cooling-down mode of air-conditioning equipment inside of a room according to the third embodiment of the present invention.

FIG. 8 is a graphical representation, showing the relation between an example of a temporal change in the temperature of the bathroom and the clothes-changing room and an example of a change in the set room temperature in a cooling-down mode of the air-conditioning equipment 104 inside of the room according to the third embodiment of the present invention.

In FIG. 8, the vertical axis Tb represents the temperature of the bathroom and the clothes-changing room detected by the temperature detection section 103 and the temperature detection section 702. Reference character Tr denotes a user-desired temperature which is used as the reference temperature and is extracted by the desired-temperature data extraction section 108. Reference characters ta, tb and tc on the horizontal axis designate a bathing-start time, a bathing-end time and an exit time from the clothes-changing room which are clocked in the timer section 106, respectively. Reference character f(t) denotes a function indicating a temporal change in the bathroom temperature, and fc(t) denotes a function indicating a temporal change in the clothes-changing room temperature. Reference symbol and character ΔTi designate the difference between a set room temperature for the cooling-down mode air-conditioning in the air-conditioning equipment 104 and the reference temperature Tr. Reference symbol and character ΔTi' designate the difference between the bathroom temperature at the bathing-end time and the average clothes-changing room temperature. Reference character ts denotes a time to execute the cooling-down mode air-conditioning.

In the special-mode time calculation section 110 of the control unit 101, how to calculate the execution time ts for the air-conditioning equipment 104 to execute the cooling-down mode air-conditioning will be described below.

The execution time ts for the cooling-down mode air-conditioning is calculated based on the user's bathing time (tb−ta) and the temporal change f(t) in the bathroom temperature which are inputted from the temperature-data recording section 107, the temperature Tr desired by the user which is inputted from the desired-temperature data extraction section 108, as well as the temporal change fc(t) in the clothes-changing room temperature and the presence time (tc−tb) in the clothes-changing room. Herein, it is calculated using the following expressions (9) to (11).

$$Sb=\int_{ta}^{tb}(f(t)-Tr)dt \tag{9}$$

$$Sc=\int_{tb}^{tc}(f(tb)-fc(t))dt \tag{10}$$

$$ts=\alpha\cdot(Sb-Sc) \tag{11}$$

In this expression (9), Sb is an integral equation which is composed of the temporal change f(t) in the bathroom temperature and the temperature Tr desired by the user which is the reference temperature. It is equivalent to the area of the hatched part of FIG. 8. In the above described expression (10), Sc is an integral equation which is composed of the value at the bathing-end time of the temporal change f(t) in the bathroom temperature and the temporal change fc(t) in the clothes-changing room temperature. It is equivalent to the area of the vertically-striped part of FIG. 8. As shown in the expression (11), if the value left after Sc is subtracted from Sb is multiplied by a coefficient α, the product is the execution time ts for the cooling-down mode air-conditioning.

Herein, the coefficient α is calculated using the following expression (3) of the first embodiment.

As ΔTi, a value which is stored in advance in the special-mode reference section 109 may also be used, but here, it is calculated using the following expression (12).

$$\Delta Ti=\gamma/\Delta Ti' \quad (12)$$

In this expression (12), for example, γ is a coefficient given in advance from the result of a subject experiment or the like. ΔTi' is the difference between the bathroom temperature at the bathing-end time and the average clothes-changing room temperature. Hence, the above described ΔTi is a coefficient correlative to the temperature difference ΔTi'. The greater the value ΔTi' becomes, the smaller the value ΔTi will be (e.g., they are inversely proportional to each other).

FIG. 9 is a table, showing an example of a clothes-changing room presence time, a clothes-changing room temperature change and the difference in temperature between the bathroom and the clothes-changing room. In the table of FIG. 9, for example, the user's clothes-changing room presence time (tc−tb) is 10 minutes. The bathroom temperature is 29° C. at the time when the user comes into it, and the bathroom temperature is 29° C. at the time when the user leaves it. The difference (ΔTi') between the bathroom temperature and the clothes-changing room temperature (i.e., the average temperature). The reference temperature is 3° C. Hereinafter, a specific description will be given using the data example shown in FIG. 9.

Figure 10:
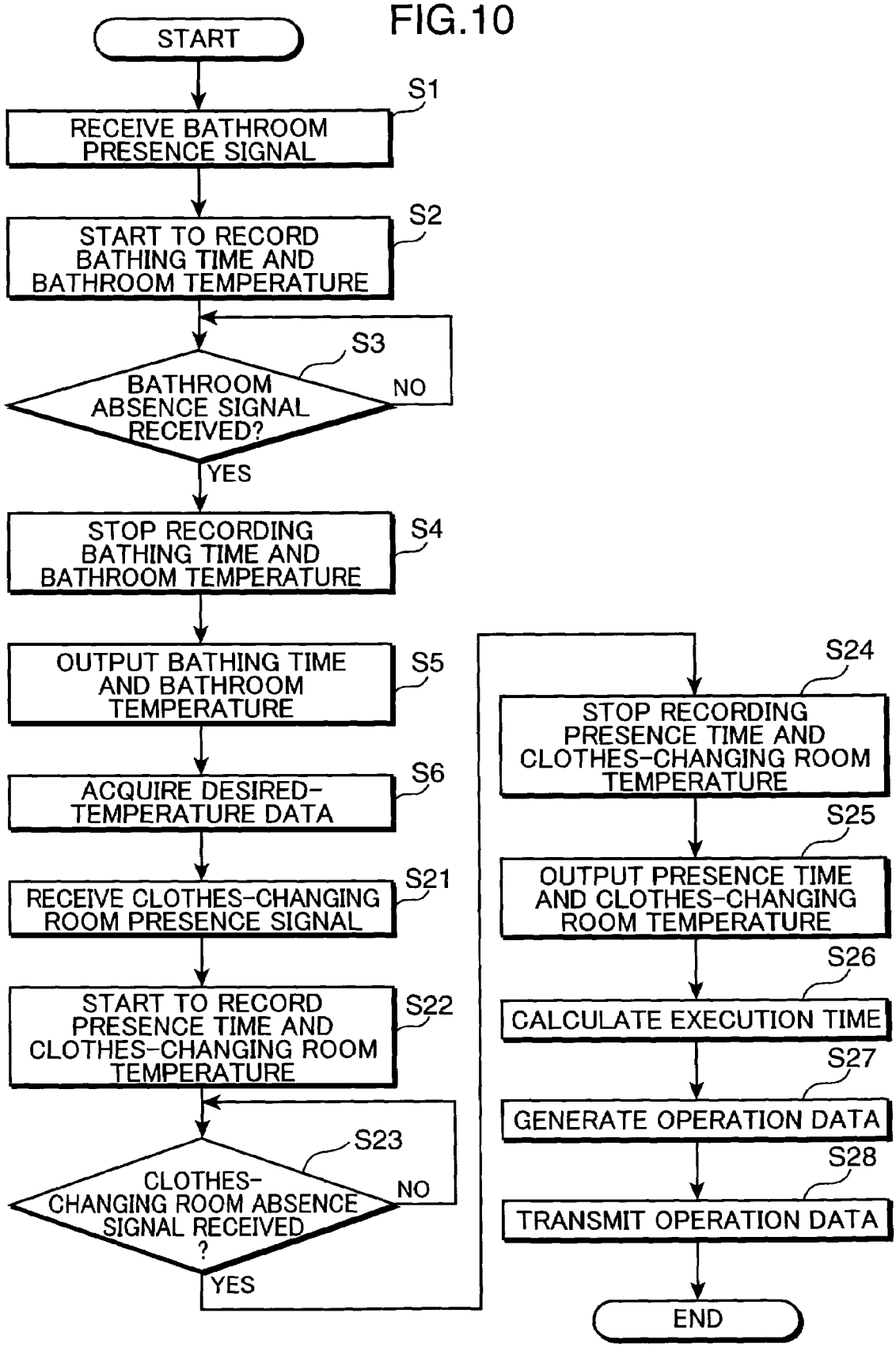
FIG. 10 is a flow chart, showing the process of a control unit outputting data on the operation of air-conditioning equipment according to the third embodiment of the present invention.

FIG. 10 is a flow chart, showing the process of the control unit 101 outputting data on the operation of the air-conditioning equipment 104 according to the third embodiment of the present invention.

In FIG. 10, the control unit 101's processing (i.e., the processing from a step S1 to a step S6) from the reception of a bathroom presence signal from the bathroom presence-and-absence sensor 102 to the output of a temperature desired by the user from the desired-temperature data extraction section 108 is the same as the processing of the first embodiment shown in FIG. 4. Hence, each step is given the same reference character and numeral, and thus, their description is omitted.

The interface section 105 of he control unit 101 receives a clothes-changing room presence signal indicating that the user is staying in the clothes-changing room from the state detection section (i.e., the clothes-changing room presence-and-absence sensor) 701 (in a step S21). The interface section 105 outputs this clothes-changing room presence signal to the temperature-data recording section 107. Next, on receiving an input of the clothes-changing room presence signal, the temperature-data recording section 107 prompts the timer section 106 to start clocking the clothes-changing room presence time. Then, it acquires, via the interface section 105, a clothes-changing room temperature which is detected by the temperature detection section 702. Herein, from the point of the clothes-changing room temperature 29° C. detected by the temperature detection section 702, the temperature-data recording section 107 receives a clothes-changing room temperature at regular intervals through the interface section 105. Then, it continues to record them as a temporal change in the clothes-changing room temperature until receiving a clothes-changing room absence signal from the clothes-changing room presence-and-absence sensor 701 (in a step S22).

Next, the temperature-data recording section 107 decides whether it has received the clothes-changing room absence signal indicating that the user is not staying in the clothes-changing room (in a step S23). If it decides that it has not received the clothes-changing room absence signal (NO at the step S23), it makes a decision repeatedly at regular intervals until receiving the clothes-changing room absence signal. On the other hand, if it decides that it has received the clothes-changing room absence signal (YES at the step S23), the processing shifts to a step S24.

After receiving the clothes-changing room presence signal via the interface section 105 from the clothes-changing room presence-and-absence sensor 701, the temperature-data recording section 107 receives the clothes-changing room absence signal through the interface section 105 (YES at the step S23). Then, it records the clothes-changing room temperature 29° C. at this time for the last time. Sequentially, it stops the timer section 106 from clocking the clothes-changing room presence time and stops recording a temporal change in the clothes-changing room temperature (in the step S24). Next, the temperature-data recording section 107 outputs the clothes-changing room presence time clocked by the timer section 106 and the temporal change in the clothes-changing room temperature to the special-mode time calculation section 110 (in a step S25). The period of time when the user has stayed in the clothes-changing room (i.e., the clocked period of time from the reception of the clothes-changing room presence signal to the reception of the clothes-changing room absence signal) is regarded as the clothes-changing room presence time. Assuming the clothes-changing room presence time to be 10 minutes, the temperature-data recording section 107 outputs, to the special-mode time calculation section 110, 10 minutes and the temporal change fc(t) in the clothes-changing room temperature obtained by continuing to record it for 10 minutes.

Next, on receiving an input of the clothes-changing room presence time of 10 minutes and the temporal change fc(t) in the clothes-changing room temperature from the temperature-data recording section 107, the special-mode time calculation section 110 calculates the difference ΔTi' between the bathroom temperature at the bathing-end time and the average clothes-changing room temperature. Using the above described expression (12), it calculates the temperature difference ΔTi, and by assigning this temperature difference ΔTi to the above described expression (3), it calculates the coefficient α. Sequentially, the special-mode time calculation section 110 registers ΔTi which it has calculated using the expression (12) in the special-mode reference section 109. Herein, ΔTi is calculated by setting the difference ΔTi' between the bathroom temperature 32° C. at the bathing-end time and the average clothes-changing room temperature 29° C., to 3° C. Thereafter, the coefficient α is calculated. After calculating the coefficient α, the special-mode time calculation section 110 assigns, to the above described expressions (9) to (11), the function f(t) indicating the temporal change from 30° C. to 32° C. in the bathroom temperature, the function fc(t) indicating the temporal change from 29° C. to 29° C. in the clothes-changing room temperature, the bathing time of 25 minutes, the clothes-changing room presence time of 10 minutes, the user-desired temperature 26° C. and the coefficient α calculated using the expression (3). Thereby, it calculates the execution time ts for the cooling-down mode air-conditioning in the air-conditioning equipment 104. Then, the special-mode time calculation section 110 outputs this execution time ts to the operation-data generation section 111 (in a step S26).

Herein, in this embodiment, the difference ΔTi' between the bathroom temperature at the bathing-end time and the average clothes-changing room temperature is designed to be 3° C. However, if ΔTi' is equal to, or less than, a specific value (e.g., about 1° C. so that the average clothes-changing room temperature does not differ much from the bathroom temperature at the bathing-end time), the temporal change fc(t) in the clothes-changing room temperature may also be considered to continue from the temporal change f(t) in the bathroom temperature. In this case, the special-mode time calculation section 110 assigns the temporal change f(t) in the bathroom temperature from the bathing-start time ta until the clothes-changing room exit time tc to the expressions (1) and (2) of the first embodiment. Thereby, it calculates the execution time ts for the cooling-down mode air-conditioning.

Next, upon receiving an input of the execution time ts for the cooling-down mode air-conditioning from the special-mode time calculation section 110, the operation-data generation section 111 generates operation data for executing the cooling-down mode air-conditioning for the execution time ts inputted from the special-mode time calculation section 110 (in a step S27). This cooling-down mode air-conditioning is supposed to lower the set room temperature by ΔTi from the room temperature optionally set by the user on the basis of ΔTi stored in the special-mode reference section 109. Sequentially, the operation-data generation section 111 transmits the operation data via the interface section 105 to the air-conditioning equipment 104 (in a step S28). Herein, when the cooling-down mode air-conditioning is executed in the room, if ΔTi as the degree to which the set room temperature should be lowered in the cooling-down mode air-conditioning is wider than a certain temperature range, then the operation-data generation section 111 may also correct ΔTi so that it becomes equal to such a certain value.

After receiving the operation data from the control unit 101, according to this operation data, the air-conditioning equipment 104 executes control so as to execute the cooling-down mode air-conditioning for the execution time ts.

In this way, user information indicating the state of a user in a third area where the user has stayed until moving from a first area to a second area, and temperature data in the third area are received. Based on the received user information, a period of time when the user has stayed in the third area is clocked. Then, the clocked period of time when the user has stayed in the third area is recorded, and by relating the received temperature data to this period of time, this temperature data is recorded as a temporal change in the temperature of the third area in the temperature-data recording section 107. Using the period of time when the user has stayed in the first area, the temporal change in the temperature of the first area and a reference temperature that is a predetermined temperature, as well as the period of time when the user has stayed in the third area, the temporal change in the temperature of the third area which are recorded in the temperature-data recording section 107, an execution time to execute a control operation of the air-conditioning equipment is calculated based on the control information stored in the special-mode reference section 109.

Specifically, the control unit 101 calculates an execution time to execute a special-mode operation in the indoor air-conditioning equipment 104, on the basis of a bathing time in a bathroom, a temporal change in the bathroom temperature, a temperature desired by a user which is the reference temperature, and ΔTi registered in advance, as well as a period of time when the user has stayed in a clothes-changing room until moving from the bathroom to the room, and a temporal change in the clothes-changing room temperature. Therefore, the special-mode operation can be executed for a more suitable period. This makes it possible to execute an efficient operation which can fully satisfy the user with a comfortable feeling by utilizing a natural temperature difference.

Furthermore, the change quantity ΔTi in the setting contents of control information which is stored in the special-mode reference section 109 is calculated based on the temperature difference ΔTi' between the first area and the third area. Therefore, the set room temperature for a special-mode operation in the air-conditioning equipment 104 can be varied according to the environment of a clothes-changing room where a user has stayed immediately before moving into the room. This helps precisely grasp the environment which the user has gradually felt bodily, and thereby, execute a meticulous air-conditioning operation.

Moreover, if the temperature difference ΔTi' between the first area and the third area is below a predetermined value (e.g., some 1° C. so that the temperature of the third area does not differ much from the bathroom temperature at the bathing-end time), the first area and the third area can also be considered to be a single area. Therefore, the case in which a plurality of environments where a user has stayed before entering the room are not different largely from each other can be taken into account. This makes it possible to execute air-conditioning control which reflects the user's state more accurately.

In addition, when the cooling-down mode air-conditioning is executed in the room, by setting a limit to operation control of the cooling-down mode air-conditioning, the setting contents of the air-conditioning equipment 104 may be corrected so that the environment can be prevented from changing too much from before entering the room. This helps keep a user from undergoing a sharp thermal change when moving into the room from the clothes-changing room. Thereby, more comfortable air-conditioning operation can be realized.

Incidentally, in this embodiment, the difference between the bathroom temperature at the bathing-end time and the average clothes-changing room temperature is designed to be ΔTi'. However, ΔTi' may also be determined by calculating the difference between the bathroom temperature and the clothes-changing room temperature, for example, calculating the difference between the average bathroom temperature and the average clothes-changing room temperature.

Fourth Embodiment

In a fourth embodiment of the present invention, similarly to the second embodiment, as an example, let's assume that a bathroom corresponds to an environment (i.e., the first area) where the user has stayed before entering a room (i.e., the second area) provided with the air-conditioning equipment 104. The state detection section 102 is assumed to be a bathroom presence-and-absence sensor, and the temperature detected by the temperature detection section 103 is assumed to be a bathroom temperature. Furthermore, let's call the special-mode operation in the air-conditioning equipment 104 a cooling-down mode air-conditioning. Hereinafter, a specific description will be given thereof.

Similarly to the second embodiment, in the control unit 101, the special-mode time calculation section 110 calculates the execution time ts to execute the cooling-down mode air-conditioning in the air-conditioning equipment 104. It is different from the second embodiment, in the following respect. Not only does the special-mode time calculation section 110 calculate the execution time ts for the cooling-down mode air-conditioning, but also it determines a change in ΔTi (i.e., a change in its strength) within the execution time ts in the cooling-down mode air-conditioning on the basis of the temporal change f(t) in the bathroom temperature recorded in the temperature-data recording section 107. Then, it outputs, to the operation-data generation section 111, the control contents of the cooling-down mode air-conditioning which indicates the change in the strength of ΔTi within the execution time ts.

Figure 11:
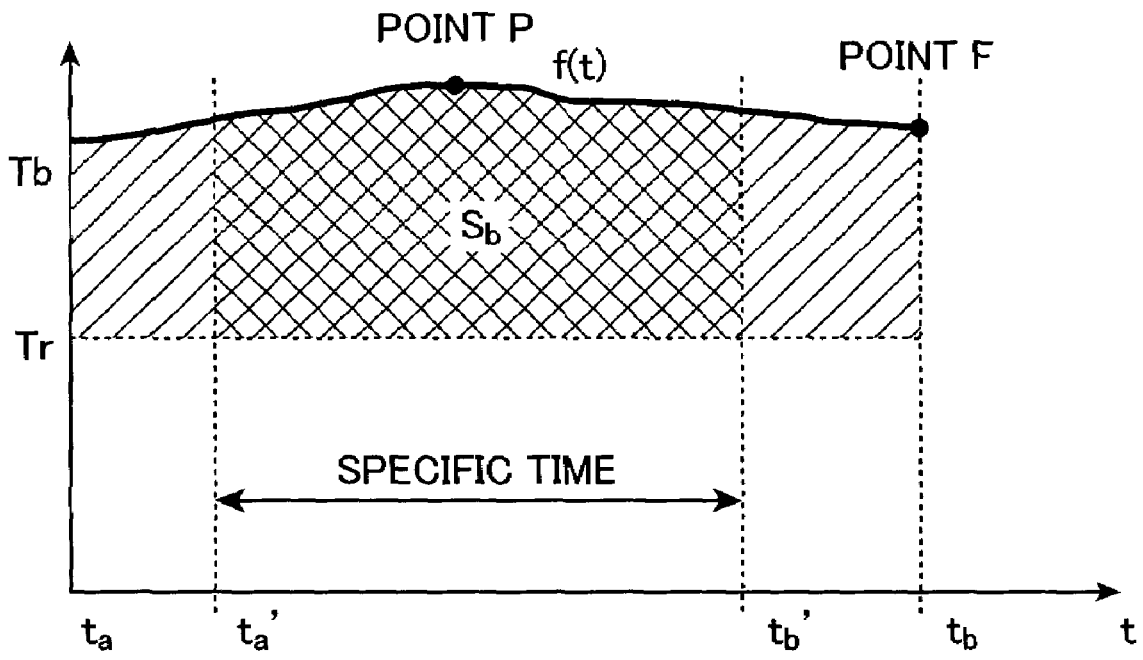
FIG. 11 is a graphical representation, showing an example of a temporal change in the temperature of a bathroom according to a fourth embodiment of the present invention.

FIG. 11 is a graphical representation, showing an example of a temporal change in the temperature of a bathroom according to the fourth embodiment of the present invention.

In the same way as the second embodiment, the vertical axis Tb represents the bathroom's temperature detected by the temperature detection section 103. Reference character Tr denotes a user-desired temperature which is used as the reference temperature and is extracted by the desired-temperature data extraction section 108. Reference characters ta and tb on the horizontal axis designate a bathing-start time and a bathing-end time which are clocked in the timer section 106, respectively. Reference character f(t) denotes a function indicating a temporal change in the bathroom temperature.

In FIG. 11, similarly to the second embodiment, if the user's bathing time inputted from the temperature-data recording section 107 has exceeded the specific time, the special-mode time calculation section 110 detects the point of time when the highest temperature is recorded on the temporal change f(t) in the bathroom temperature during the bathing time. Then, the special-mode time calculation section 110 calculates the execution time ts for the cooling-down mode air-conditioning, using the temporal change f(t) in the bathroom temperature within the range from the point ta' to the point tb' which continues for the specific time so that its middle becomes the highest-temperature record point.

Incidentally, in this embodiment, the execution time is calculated, using the temporal change f(t) in the bathroom temperature within the time range which continues for the specific time so that its middle becomes the highest-temperature record point. However, the present invention is not limited especially to this. The execution time may also be calculated, using the temporal change f(t) in the bathroom temperature within the time range which includes the highest-temperature record point and continues for the specific time.

In the special-mode time calculation section 110, a table is stored beforehand in which the relation between the peak point (hereinafter, referred to as the point P) and the bathing-end time (hereinafter, referred to as the point F) on the temporal change f(t) in the bathroom temperature corresponds to a change in the strength of ΔTi in the cooling-down mode air-conditioning which is stored in advance in the special-mode reference section 109.

Upon calculating the execution time ts for the cooling-down mode air-conditioning, the special-mode time calculation section 110 extracts the point P and the point F. Then, the special-mode time calculation section 110 refers to the table in which the relation between the point P and the point F corresponds to the change in the strength of ΔTi. Sequentially, it determines the control contents of the cooling-down mode air-conditioning which indicates the change in the strength of ΔTi within the execution time ts. Then, it outputs these control contents to the operation-data generation section 111.

FIG. 12 is a table, showing an example of the correspondence of the relation between the point P and the point F stored in advance in the special-mode time calculation section 110 to the change in the strength of ΔTi according to the fourth embodiment of the present invention.

In FIG. 12, if the time interval between the point P and the point F extracted by the special-mode time calculation section 110 is short and if their temperature difference is also small, ΔTi for the cooling-down mode air-conditioning is determined to change in order of weak→medium→strong during the execution time ts. Herein, the timetable of weak, medium and strong during the execution time ts is determined, for example, by dividing the execution time ts into three. As the strength, for example, weak corresponds to ΔTi/3; medium, 2·ΔTi/3; and strong, ΔTi, respectively. After this, in the same way, the control contents of the cooling-down mode air-conditioning are determined, using the time interval between the point P and the point F and the difference in temperature between the point P and the point F.

Upon receiving an input of the control contents of the cooling-down mode air-conditioning, for example, first, a weak operation, next, a medium operation and last, a strong operation from the special-mode time calculation section 110, the operation-data generation section 111 refers to ΔTi which is the setting of the cooling-down mode air-conditioning stored in the special-mode reference section 109. Then, it generates operation data for executing this cooling-down mode air-conditioning in order of, first, weak (⅓·ts), sequentially, medium (⅓·ts) and finally, strong (⅓·ts). Next, the operation-data generation section 111 transmits the operation data via the interface section 105 to the air-conditioning equipment 104.

After receiving the operation data from the control unit 101, according to this operation data, the air-conditioning equipment 104 executes control of the air-conditioning.

In this way, on the basis of a temporal change in the temperature of an environment where a user has stayed before coming into a room provided with the air-conditioning equipment 104, a special-mode operation in the indoor air-conditioning equipment 104 can be varied. This makes it possible to realize control which reflects more precisely the user's state at the time when entering the room. Besides, even in the case where the contents of a special-mode operation differs greatly from an environment before a user enters the room, the operation can be initially started from a weak one. Hence, the burden imposed on the user's body becomes light, thus preventing a trouble, such as a heat shock which has recently been put in question, from developing.

In this embodiment, in the timetable of the strength change during the execution time ts for ΔTi of the cooling-down mode air-conditioning, it is simply divided along the change of weak→medium→strong or the like into three equal parts. However, for example, if the point P on f(t) has lasted for a certain period of time, the timetable of the weak operation of ΔTi in the cooling-down mode air-conditioning may also be designed to be inversely proportional to the certain period of time when the point P has continued. In sum, the time for the change in the strength of ΔTi in the cooling-down mode air-conditioning may also be allocated according to the variation in the temperature temporal change f(t) during the bathing time.

Furthermore, in this embodiment, the above description is given in the case where the temperature of the environment in which the user has stayed before entering a room provided with the air-conditioning equipment 104 is generally higher than the reference temperature Tr. However, a case in which the environment before the user enters the room is not a bathroom may also be considered. Specifically, the lowest-temperature point which is the worst condition on f(t) is extracted, and then, the strength change in the temperature difference ΔTi by which the set room temperature should be raised from a room temperature which is usually set optionally by the user is determined on the basis of the time interval between this lowest-temperature point and the bathing-end time, and the difference in temperature between the lowest-temperature point and the bathing-end time.

Fifth Embodiment

Figure 13:
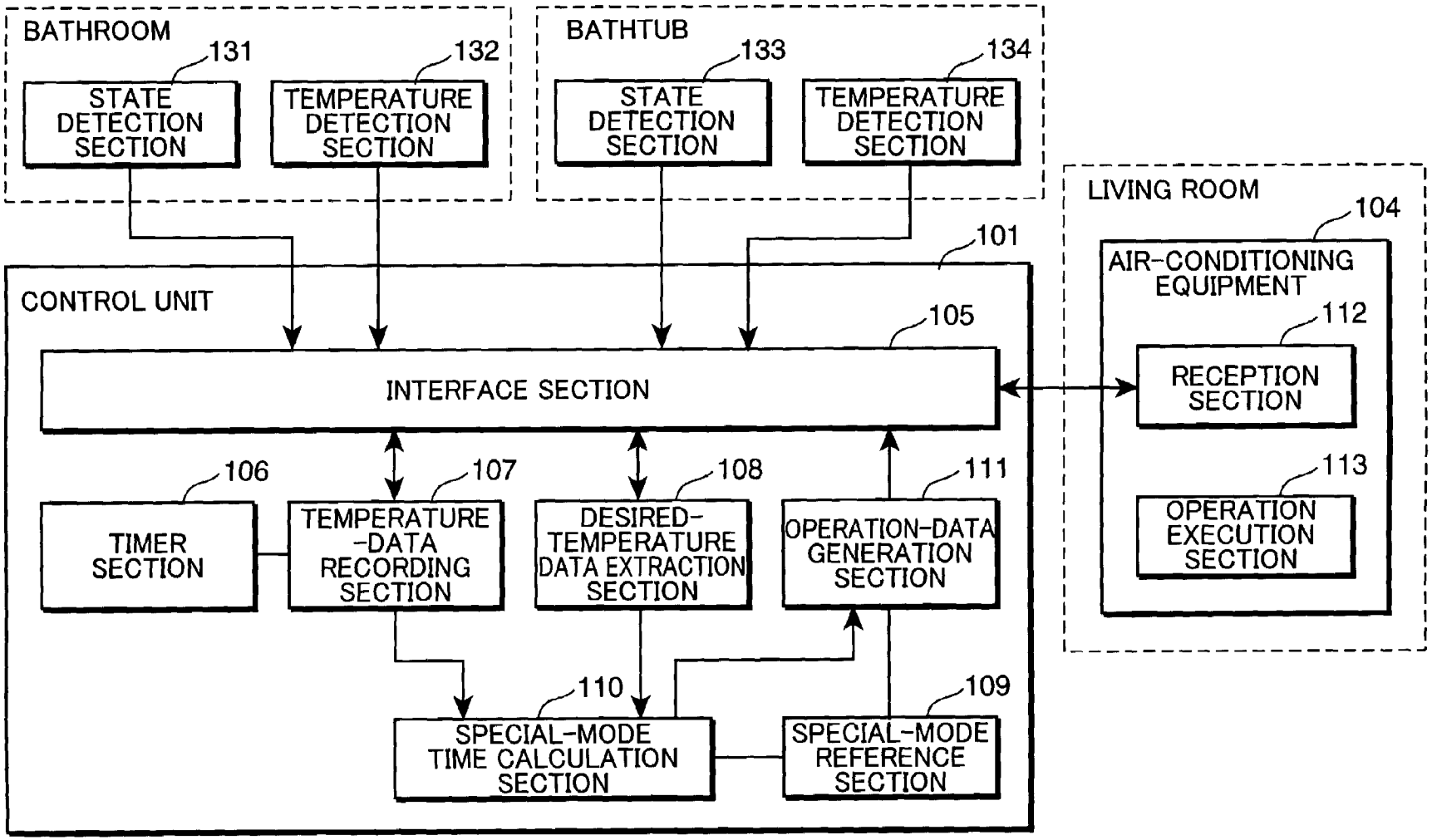
FIG. 13 is a block diagram, showing the configuration of a control system according to a fifth embodiment of the present invention.

FIG. 13 is a block diagram, showing the configuration of a control system according to a fifth embodiment of the present invention.

In FIG. 13, a control unit 101, air-conditioning equipment 104, an interface section 105, a timer section 106, a temperature-data recording section 107, a desired-temperature data extraction section 108, a special-mode reference section 109, a special-mode time calculation section 110, and an operation-data generation section 111 each have the same configuration as the identical component elements according to the first embodiment. Hence, their description is omitted. A state detection section 131 is provided in a bathroom (i.e., the first area). It is a presence-and-absence sensor which detects the user staying in the bathroom. A temperature detection section 132 is provided in the bathroom (i.e., the first area) and detects the bathroom air temperature (hereinafter, referred to as the bathroom temperature). A state detection section 133 is provided in a bathtub (i.e., the third area). It is a presence-and-absence sensor which detects the user staying in the bathtub. A temperature detection section 134 is provided in the bathtub (i.e., the third area) and detects the temperature of water stored in the bathtub (hereinafter, referred to as the warm-water temperature). The air-conditioning equipment 104 is provided, for example, in a living room (i.e., the second area).

In this embodiment, the state detection section 131 corresponds to an example of the bathroom-state detecting section; the state detection section 133, to an example of the bathtub-state detecting section; the temperature detection section 132, to an example of the bathroom-temperature detecting section; the temperature detection section 134, to an example of the bathtub-temperature detecting section.

In the fifth embodiment of the present invention, the first area where the user has stayed before entering the room provided with the air-conditioning equipment 104 which is the second area is the bathroom, and the third area is the bathtub. The state detection section 131 is the bathroom presence-and-absence sensor, and the temperature detected by the temperature detection section 132 is the bathroom temperature. The state detection section 133 is the bathtub presence-and-absence sensor, and the temperature detected by the temperature detection section 134 is the warm-water temperature. The special-mode operation in the air-conditioning equipment 104 is called a cooling-down mode air-conditioning. Hereinafter, a description will be given thereof.

This embodiment is different from the first embodiment, in the following respect. When calculating the execution time ts for the cooling-down mode air-conditioning, the special-mode time calculation section 110 takes into account the difference between the effect of warm water in the bathtub as the third area upon the user and the effect of air in the bathroom as the first area upon the user described in the first embodiment.

Herein, the bathroom presence-and-absence sensor 131 detects the user staying in the bathroom and the user not staying any longer in the bathroom. Then, it transmits information for reporting those facts to the control unit 101. The bathtub presence-and-absence sensor 133 detects the user staying in the bathtub and the user not staying any longer in the bathtub. Then, it transmits information for reporting those facts to the control unit 101.

The bathtub presence-and-absence sensor 133 extracts a change in the warm-water level and how fast the level has changed. Then, it compares this level change and the change speed with a predetermined threshold to detect the user staying or not in the bathtub. Or, the bathtub presence-and-absence sensor 133 is provided with a pressure sensor disposed in a place where the user's body touches it when sitting in the bathtub. It detect the user touching this pressure sensor to detect the user staying or not in the bathtub.

Figure 14:
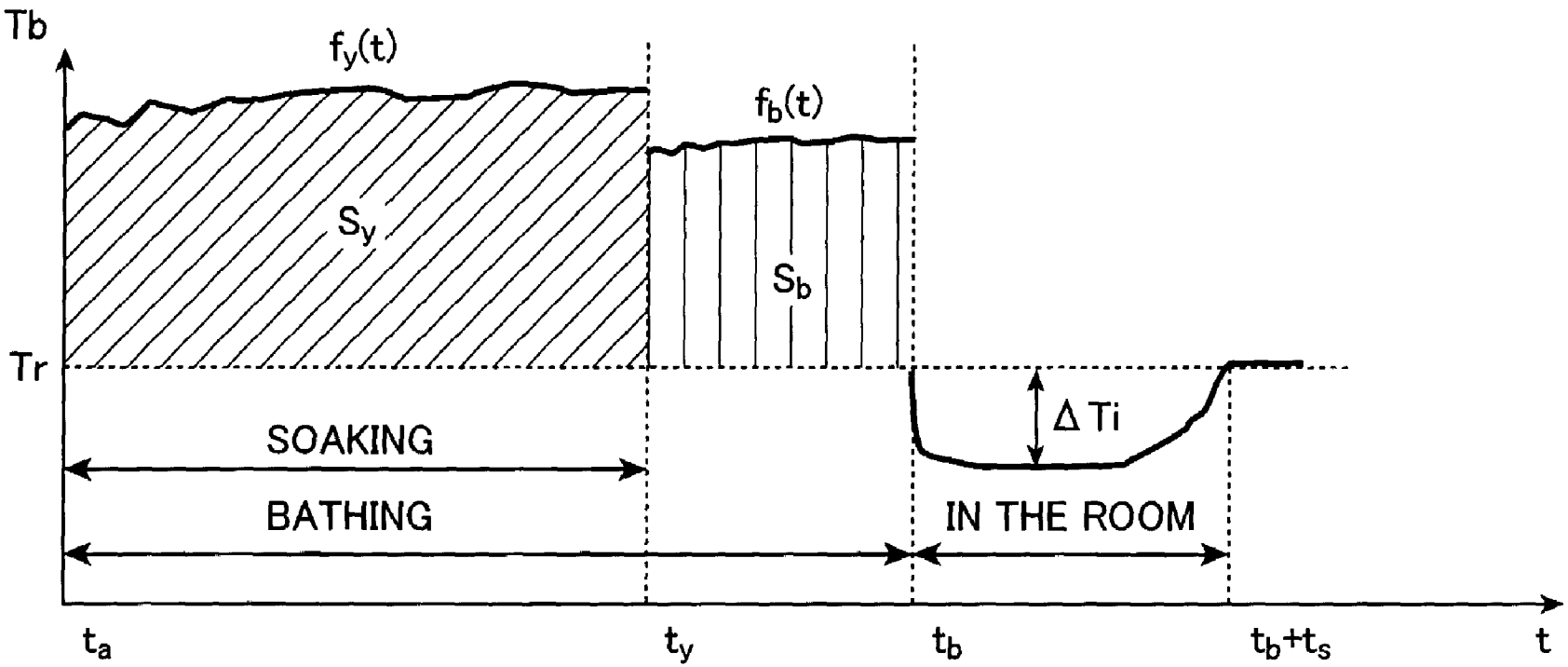
FIG. 14 is a graphical representation, showing the relation between an example of a temporal change in the temperature of a bathroom and a bathtub and an example of a change in the set room temperature in a cooling-down mode of air-conditioning equipment inside of a room according to the fifth embodiment of the present invention.

FIG. 14 is a graphical representation, showing the relation between an example of a temporal change in the temperature of the bathroom and the bathtub and an example of a change in the set room temperature in a cooling-down mode of the air-conditioning equipment 104 inside of the room according to the fifth embodiment of the present invention.

In FIG. 14, the vertical axis Tb represents the bathroom temperature and the warm-water temperature detected by the temperature detection section 132 and the temperature detection section 134. Reference character Tr denotes a user-desired temperature which is used as the reference temperature and is extracted by the desired-temperature data extraction section 108. Reference characters ta, ty and tb on the horizontal axis designate a bathing-start time (or a soaking-start time), a soaking-end time and a bathing-end time which are clocked in the timer section 106 on the basis of the user's presence-and-absence information detected by the bathroom presence-and-absence sensor 131 and the bathtub presence-and-absence sensor 133, respectively. Reference character fy(t) denotes a function indicating a temporal change in the warm-water temperature, and fb(t) denotes a function indicating a temporal change in the bathroom temperature. Reference symbol and character ΔTi designate the difference between a setting (e.g., a set room temperature) which is usually executed optionally by the user and a setting (e.g., a set room temperature) for the cooling-down mode air-conditioning in the air-conditioning equipment 104. Reference character ts denotes a time to execute the cooling-down mode air-conditioning.

In the special-mode time calculation section 110 of the control unit 101, how to calculate the execution time ts for the air-conditioning equipment 104 to execute the cooling-down mode air-conditioning will be described below. The execution time ts for the cooling-down mode air-conditioning is calculated based on the user's soaking time (ty−ta) in the bathtub, the temporal change fy(t) in the warm-water temperature, the time (tb−ty−ta) when the user has stayed in the bathroom but outside of the bathtub and the temporal change fb(t) in the bathroom temperature which are inputted from the temperature-data recording section 107, and the temperature Tr desired by the user which is inputted from the desired-temperature data extraction section 108. Herein, it is calculated using the following expressions (13) to (15).

$$Sy=\int_{ta}^{ty}(fy(t)-Tr)dt \tag{13}$$

$$Sb=\int_{ty}^{tb}(fb(t)-Tr)dt \tag{14}$$

$$ts=\alpha\cdot(\theta Sy+Sb) \tag{15}$$

In this expression (13), Sy is an integral equation which is composed of the temporal change fy(t) in the warm-water temperature and the temperature Tr desired by the user which is the reference temperature. It is equivalent to the area of the hatched part of FIG. 14. In the above described expression (14), Sb is an integral equation which is composed of the temporal change fb(t) in the bathroom temperature and the temperature Tr desired by the user which is the reference temperature. It is equivalent to the area of the vertically-striped part of FIG. 14. In the above described expression (15), reference character θ is a predetermined coefficient in consideration of the fact that the influence of warm water on the human body is greatly different from the influence of air on it. It is a coefficient of one or above which is determined based on the fact that the thermal conductivity of water is twenty-five times as high as the thermal conductivity of air, the heat capacity of water is different from that of air, or the like. Then, if the value obtained by adding θ times as large as Sy and Sb together is multiplied by a coefficient α, the product is the execution time ts for the cooling-down mode air-conditioning. Herein, the coefficient α is calculated using the following expression (3) of the first embodiment.

Figure 15:
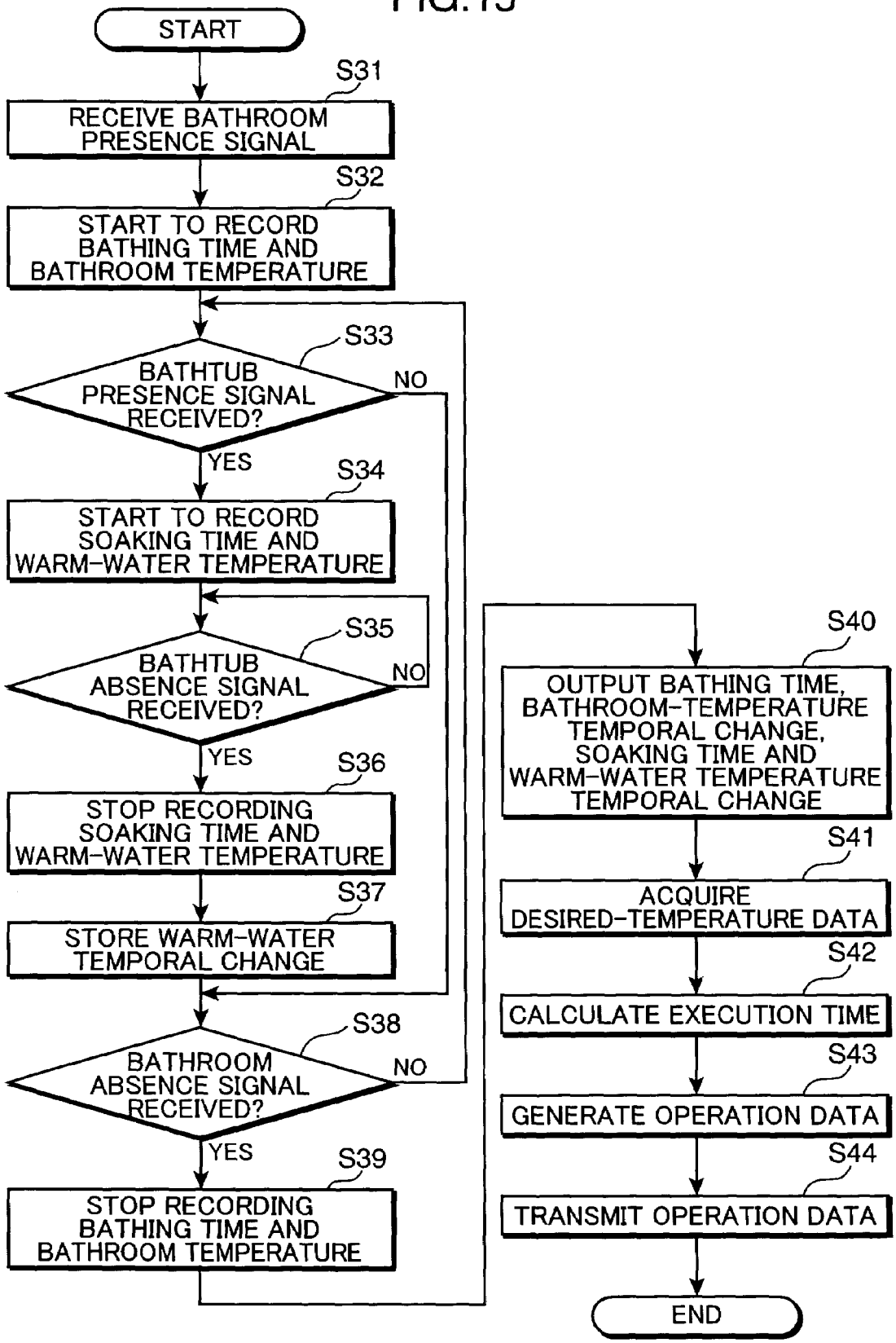
FIG. 15 is a flow chart, showing the process of a control unit outputting data on the operation of air-conditioning equipment according to the fifth embodiment of the present invention.

FIG. 15 is a flow chart, showing the process of the control unit 101 of FIG. 13 outputting data on the operation of the air-conditioning equipment 104.

In FIG. 15, first, in the same way as the first embodiment, the interface section 105 receives a bathroom presence signal indicating that the user is staying in the bathroom from the state detection section (i.e., the bathroom presence-and-absence sensor) 131 (in a step S31). The interface section 105 outputs this bathroom presence signal to the temperature-data recording section 107. Next, on receiving an input of the bathroom presence signal, the temperature-data recording section 107 prompts the timer section 106 to start clocking the bathing time. Then, it acquires, via the interface section 105, a bathroom temperature which is detected by the temperature detection section 132. Herein, the temperature-data recording section 107 receives a bathroom temperature at regular intervals through the interface section 105 from the temperature detection section 132. Then, it continues to record them as a temporal change in the bathroom temperature until receiving a bathroom absence signal from the bathroom presence-and-absence sensor 131 (in a step S32).

Next, the temperature-data recording section 107 decides whether or not a bathtub presence signal indicating that the user is staying in the bathtub has been received (in a step S33). If it decides that the bathtub presence signal has not been received (NO at the step S33), the processing shifts to a step S38. On the other hand, if it decides that the bathtub presence signal has been received (YES at the step S33), the processing goes to a step S34.

During the period of time from the reception of the bathroom presence signal via the interface section 105 to the reception of the bathroom absence signal via the interface section 105 from the bathroom presence-and-absence sensor 131, upon receiving the bathtub presence signal via the interface section 105 from the state detection section (i.e., the bathtub presence-and-absence sensor) 133 (YES at the step S33), the temperature-data recording section 107 prompts the timer section 106 to start clocking the soaking time. Then, the temperature-data recording section 107 receives a warm-water temperature at regular intervals via the interface section 105 from the temperature detection section 134. Then, it continues to record them as a temporal change in the warm-water temperature until receiving a bathtub absence signal from the bathtub presence-and-absence sensor 133 (in the step S34).

Next, the temperature-data recording section 107 decides whether it has received a bathtub absence signal indicating that the user is not staying in the bathtub (in a step S35). Herein, if it decides that it has not received the bathtub absence signal (NO at the step S35), it makes a decision repeatedly at regular intervals until receiving the bathtub absence signal. On the other hand, if it decides that it has received the bathtub absence signal (YES at the step S35), the processing shifts to a step S36.

Upon receiving the bathtub absence signal through the interface section 105 (YES at the step S35), the temperature-data recording section 107 records the warm-water temperature at this time for the last time. Sequentially, it stops the timer section 106 from clocking the soaking time and stops recording a temporal change in the warm-water temperature (in the step S36). Next, the temperature-data recording section 107 stores the soaking time clocked by the timer section 106 and the temporal change in the warm-water temperature (in a step S37).

Next, the temperature-data recording section 107 decides whether or not it has received a bathroom absence signal indicating that the user is not staying in the bathroom (in a step S38). Herein, if it decides that it has not received the bathroom absence signal (NO at the step S38), the processing returns to the step S33. Then, it decides whether or not it has received the bathtub presence signal. On the other hand, if it decides that it has received the bathroom absence signal (YES at the step S38), the processing moves to a step S39.

Thereafter, upon receiving the bathroom absence signal via the interface section 105 (YES at the step S38), the temperature-data recording section 107 records the bathroom temperature at this time for the last time. Sequentially, it stops the timer section 106 from clocking the bathing time and stops recording a temporal change in the bathroom temperature (in a step S39). Next, the temperature-data recording section 107 outputs, to the special-mode time calculation section 110, the bathing time, the temporal change in the bathroom temperature, the soaking time stored so far and the temporal change in the warm-water temperature (in a step S40).

Next, the desired-temperature data extraction section 108 receives data on a room temperature set in the air-conditioning equipment 104 via the interface section 105. Then, it outputs this set room-temperature data as the temperature desired by the user to the special-mode time calculation section 110 (in a step S41).

Next, in the special-mode time calculation section 110, the user-desired temperature is inputted from the desired-temperature data extraction section 108 and the bathing time, the temporal change in the bathroom temperature, the soaking time and the temporal change in the warm-water temperature are inputted from the temperature-data recording section 107. Then, it calculates the coefficient α in the same way as the first embodiment. After calculating the coefficient α, the special-mode time calculation section 110 assigns, to the expressions (13) to (15), the function fb(t) indicating the temporal change in the bathroom temperature, the function fy(t) indicating the temporal change in the warm-water temperature, the time (tb−ty−ta) when the user has stayed in the bathroom but outside of the bathtub, the soaking time (ty−ta), the user-desired temperature Tr and the coefficient α. Thereby, it calculates the execution time ts for the cooling-down mode air-conditioning in the air-conditioning equipment 104 (in a step S42). Then, the special-mode time calculation section 110 outputs this execution time ts to the operation-data generation section 111.

Next, upon receiving an input of the execution time ts for the cooling-down mode air-conditioning from the special-mode time calculation section 110, the operation-data generation section 111 refers to the setting of the cooling-down mode air-conditioning which is stored in the special-mode reference section 109. Then, the operation-data generation section 111 generates operation data for executing the cooling-down mode air-conditioning stored in the special-mode reference section 109 for the execution time ts inputted from the special-mode time calculation section 110 (in a step S43). Sequentially, the operation-data generation section 111 transmits the operation data via the interface section 105 to the air-conditioning equipment 104 (in a step S44).

After receiving the operation data from the control unit 101, in the same way as the first embodiment, according to this operation data, the air-conditioning equipment 104 executes control so as to execute the cooling-down mode air-conditioning for the execution time ts.

In this way, user information indicating the state of the user in the bathroom and the state of the user in the bathtub, temperature data in the bathroom and temperature data in the bathtub are received. Based on the received user information, a period of time when the user has stayed in the bathroom and a period of time when the user has stayed in the bathtub are clocked. Then, the clocked period of time when the user has stayed in the bathroom and the period of time when the user has stayed in the bathtub which are clocked are recorded, and by relating the received temperature data in the bathroom to the corresponding period of time, this temperature data is recorded as a temporal change in the temperature of the bathroom in the temperature-data recording section 107. Similarly, by relating the received temperature data in the bathtub to the corresponding period of time, this temperature data is recorded as a temporal change in the temperature of the bathtub in the temperature-data recording section 107. In the special-mode reference section 109, control information is stored for changing the contents of a setting in the air-conditioning equipment 104 provided in a place different from the bathroom. Then, using the period of time when the user has stayed in the bathroom, the period of time when the user has stayed in the bathtub, the temporal change in the temperature of the bathroom, the temporal change in the temperature of the bathtub, a predetermined numeric coefficient on the influence of the water inside of the bathtub on the human body, and a reference temperature that is a predetermined temperature which are recorded in the temperature-data recording section 107, an execution time to execute a control operation of the air-conditioning equipment 104 is calculated based on the control information stored in the special-mode reference section 109. Thereafter, operation data for operating the air-conditioning equipment 104 during the calculated execution time is generated based on the control information stored in the special-mode reference section 109.

Therefore, in terms of the environment before the user enters the place provided with the air-conditioning equipment 104, the fact that the user not only has stayed in the air but also has soaked in water (i.e., warm water) can be taken into account when the execution time ts for the cooling-down mode air-conditioning in the air-conditioning equipment 104 is calculated. Hence, a specialized system can be realized in a space like a bathroom which is a special environment where warm water as well as air exists together. This makes it possible to realize a more comfortable air-conditioning operation for the user.

In this embodiment, a description is given of the case where a user soaks only once in warm water while taking a bath. However, the present invention is not limited especially to this. It can be applied, even if the user soaks several times in the bathtub while bathing. For example, if the user has a plurality of soaks per bath, the special-mode time calculation section 110 adds up the integral value for each of the plurality of soaking times of the value left after the temperature Tr desired by the user is subtracted from the function fy(t) indicating each of the plurality of temporal changes in the warm-water temperature. Then, it sets the value which it obtains from this addition to Sy. In the same way, it adds up the integral value for each of the plurality of bathing times (i.e., the period of time when the user has stayed outside of the bathtub during the bathing time) of the value left after the temperature Tr desired by the user is subtracted from the function fb(t) indicating each of the plurality of temporal changes in the bathroom temperature. Then, it sets the value which it obtains from this addition to Sb. Using the above described expression (15), it calculates the execution time ts.

Sixth Embodiment

In a sixth embodiment of the present invention, similarly to the fifth embodiment, the special-mode operation in the air-conditioning equipment 104 is named a cooling-down mode air-conditioning. Hereinafter, a specific description will be given thereof. The configuration of a control system according to the sixth embodiment is the same as that of a control system according to the fifth embodiment. Hence, its description is omitted, and using the control system shown in FIG. 13, the sixth embodiment will be described below.

Similarly to the fifth embodiment, in the control unit 101, the special-mode time calculation section 110 calculates the execution time ts to execute the cooling-down mode air-conditioning in the air-conditioning equipment 104, on the basis of the bathing time, the temporal change in the bathroom temperature, the soaking time and the temporal change in the warm-water temperature which are inputted from the temperature-data recording section 107 and the user-desired temperature inputted from the desired-temperature data extraction section 108. It is different from the fifth embodiment, in the following respect. When calculating the execution time ts for the cooling-down mode air-conditioning, the special-mode time calculation section 110 decides whether the warm-water temperature inputted from the temperature-data recording section 107 is beyond a certain value given in advance. Then, how to calculate the execution time ts is changed based on the decision result.

Figure 16:
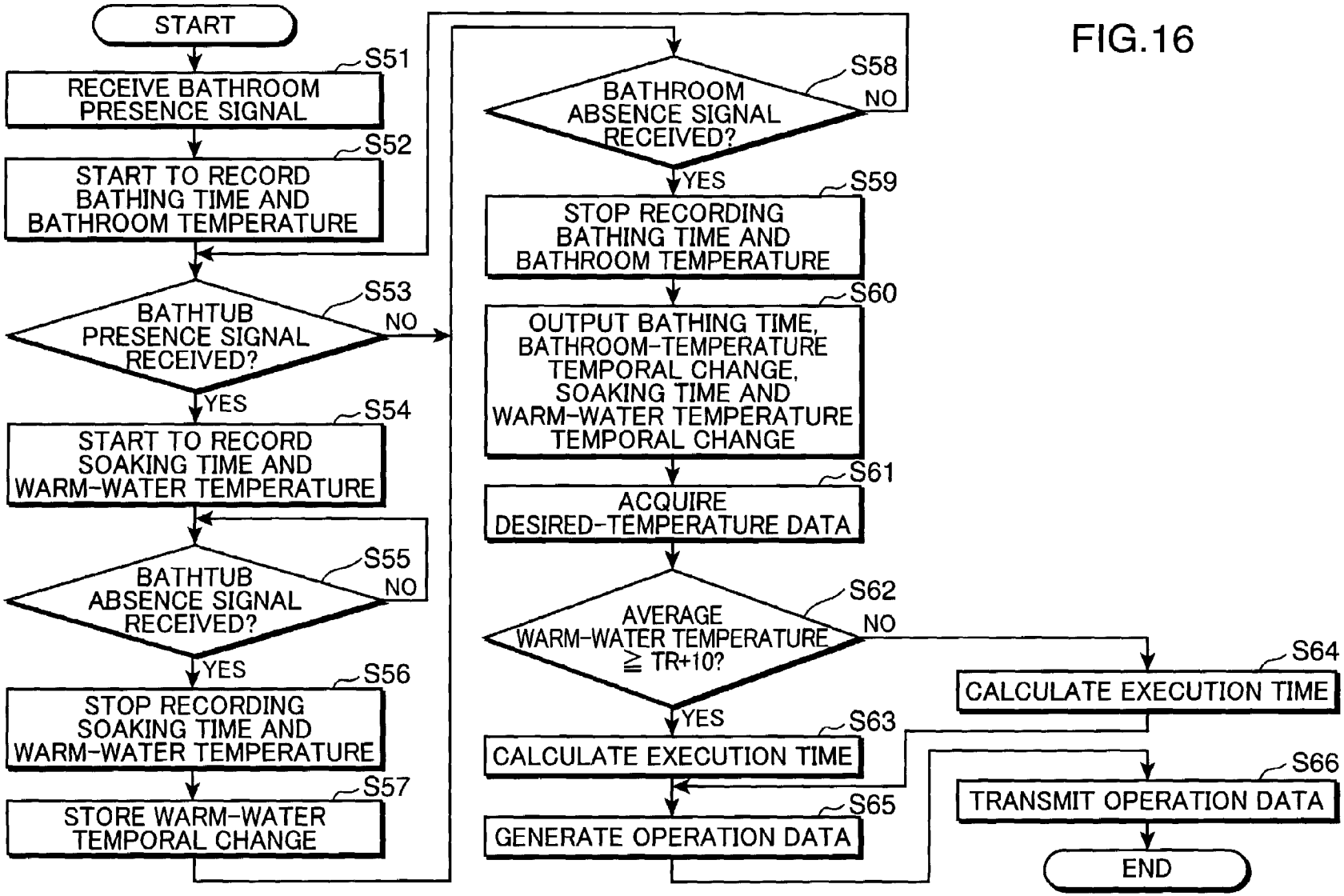
FIG. 16 is a flow chart, showing the process of a control unit outputting data on the operation of air-conditioning equipment according to a sixth embodiment of the present invention.
Figure 17:
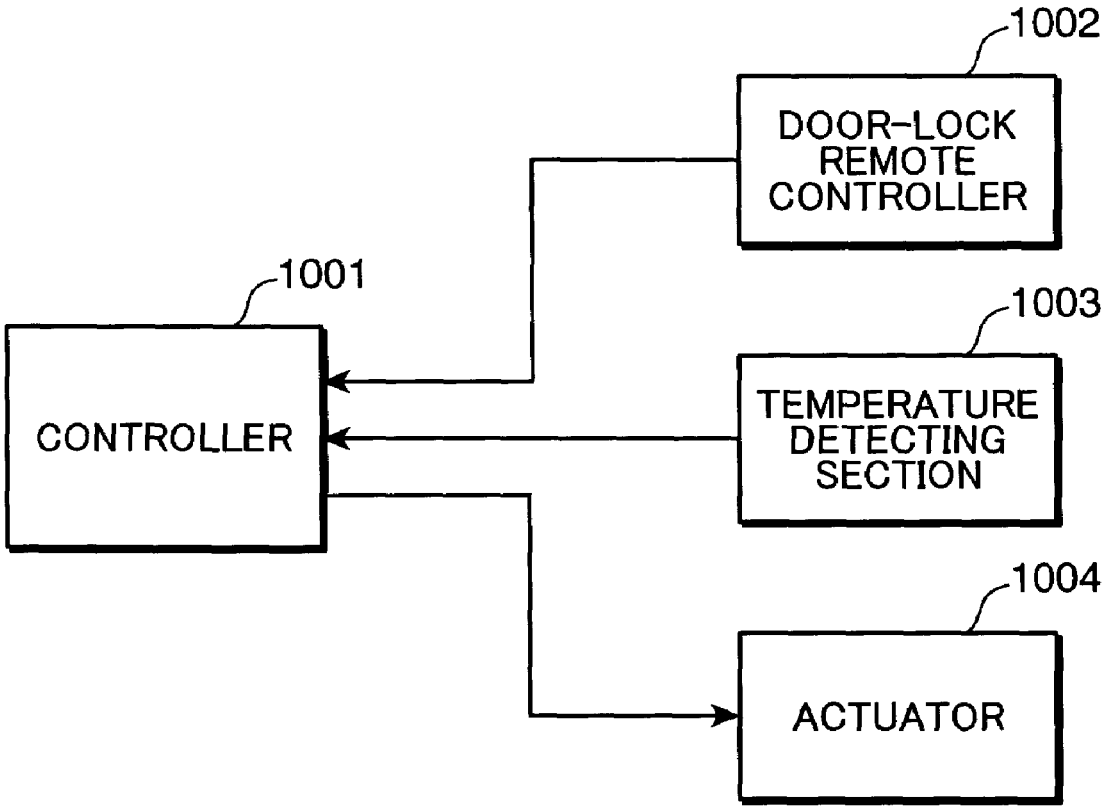
FIG. 17 is a block diagram, showing the configuration of a conventional vehicle air conditioner.

FIG. 16 is a flow chart, showing the process of the control unit 101 of FIG. 13 outputting data on the operation of the air-conditioning equipment 104 according to a sixth embodiment of the present invention.

In FIG. 16, the control unit 101's processing (i.e., the processing from a step S51 to a step S61) from the reception of a bathroom presence signal from the bathroom presence-and-absence sensor 131 to the output of a temperature desired by the user from the desired-temperature data extraction section 108 is the same as the processing from the step S31 to the step S41 of the fifth embodiment shown in FIG. 15. Hence, their description is omitted.

In the special-mode time calculation section 110, the user-desired temperature is inputted from the desired-temperature data extraction section 108 and the bathing time, the temporal change in the bathroom temperature, the soaking time and the temporal change in the warm-water temperature are inputted from the temperature-data recording section 107. Then, it calculates the coefficient $\alpha$ in the same way as the first embodiment. After calculating the coefficient $\alpha$, the special-mode time calculation section 110 decides, from the temporal change in the warm-water temperature inputted from the temperature-data recording section 107, whether the warm-water temperature is beyond a certain value (in a step S62). Herein, the certain value is, for example, the reference temperature Tr+10. At this time, from the temporal change in the warm-water temperature, the special-mode time calculation section 110 calculates its average value. Then, it decides whether or not this average value is equal to, or higher than, the certain value (i.e., the reference temperature Tr+10).

Herein, if the decision is made that the temporal average of the warm-water temperature is equal to, or higher than, the certain value, then the user is judged to have soaked at a hot-water temperature for a short time when coming into the bathtub. As a common knowledge of bathing, there is recognition that a person cannot warm himself/herself to the marrow just by soaking at a hot-water temperature for a short time. Hence, at this time, the user is judged not much warmed. Therefore, if the decision is made that the temporal average of the warm-water temperature is equal to, or higher than, the certain value (YES at a step S63), the special-mode time calculation section 110 calculates the execution time ts for the cooling-down mode air-conditioning, in the same way as the step S42 of the fifth embodiment (in the step S63).

Herein, if the decision is made that the temporal average of the warm-water temperature is lower than the certain value (i.e., the reference temperature Tr+10), then the user is judged to have soaked at a tepid-water temperature for a long time. In general, it is known that a person can get a great effect by soaking the lower-half body in a bathtub, so that the person can warm himself/herself to the marrow by soaking at a tepid-water temperature for a long time. Hence, at this time, the user is judged much warmed. Therefore, if the decision is made that the temporal average of the warm-water temperature is lower than the certain value (NO at the step S62), the special-mode time calculation section 110 calculates the execution time ts for the cooling-down mode air-conditioning, using the following expression (16) (in a step S64).

$$ts=\alpha\cdot(\delta Sy+Sb) \tag{16}$$

In this expression (16), Sy, Sb and the coefficient $\alpha$ are calculated, in the same was as the fifth-embodiment. Herein, the abode described coefficient $\delta$ is a coefficient given in advance from the result of a subject experiment or the like. Then, if the value obtained by adding $\delta$ times as large as Sy and Sb together is multiplied by a coefficient $\alpha$, the product is the execution time ts for the cooling-down mode air-conditioning. Upon calculating the execution time ts for the cooling-down mode air-conditioning using the expression (16), the special-mode time calculation section 110 outputs it to the operation-data generation section 111.

Next, upon receiving an input of the execution time ts for the cooling-down mode air-conditioning from the special-mode time calculation section 110, in the same was as the fifth embodiment, the operation-data generation section 111 refers to the setting of the cooling-down mode air-conditioning which is stored in the special-mode reference section 109. Then, the operation-data generation section 111 generates operation data for executing the cooling-down mode air-conditioning stored in the special-mode reference section 109 for the execution time ts inputted from the special-mode time calculation section 110 (in a step S65). Sequentially, the operation-data generation section 111 transmits the operation data via the interface section 105 to the air-conditioning equipment 104 (in a step S66).

As described above, according to how long a user has soaked in the water of a bathtub while bathing and what the water's temperature is, a decision is made how well the user has been warmed. This decision result is reflected in the execution time ts for the cooling-down mode air-conditioning of the air-conditioning equipment 104. Therefore, even if a user changes how to take a bath every time, such a changed manner can be faithfully reflected in the air-conditioning operation. This helps offer a comfortable air-conditioning operation to the user after the bathing. Besides, this air-conditioning follows the user's bathing manner closely, so that excessive air-conditioning can be avoided. Thereby, the air-conditioning equipment 104 can be controlled using the contents of an appropriate setting. This makes it possible to execute air-conditioning which prevents the user from falling ill because the user feels a chill after the bath or the like.

In this embodiment, a description is given of the case where a user soaks only once in warm water while taking a bath. However, even if the user soaks several times in the bathtub while taking a bath, the special-mode time calculation section 110 makes a decision on each of the plurality of temporal changes in the warm-water temperature. If the user has soaked in a tepid bath for a long time at least once, the execution time ts for the cooling-down mode air-conditioning is calculated using the expression (16).

Herein, the specific embodiments described so far mainly include an invention which has the following configurations.

A control unit according to the present invention, comprising: a receiving section for receiving user information indicating the state of a user in a first area and temperature data in the first area; a clocking section for clocking a period of time when the user stays in the first area, based on the user information received by the receiving section; a temperature-data recording section for recording the period of time when the user stays in the first area which is clocked by the clocking section, and recording the temperature data received by the receiving section as a temporal change in the temperature of the first area by relating this temperature data to the period of time clocked by the clocking section; a control-information storing section for storing control information for changing the contents of a setting in air-conditioning equipment provided in a second area different from the first area; an execution-time calculating section for, using the period of time when the user stays in the first area, the temporal change in the temperature and a reference temperature that is a predetermined temperature which are recorded in the temperature-data recording section, calculating an execution time to execute a control operation of the air-conditioning equipment based on the control information stored in the control-information storing section; and an operation-data generating section for generating operation data for operating the air-conditioning equipment during the execution time calculated by the execution-time calculating section based on the control information stored in the control-information storing section.

Furthermore, a control method according to the present invention, including: a receiving step of receiving user information indicating the state of a user in a first area and temperature data in the first area; a clocking step of clocking a period of time when the user stays in the first area, based on the user information received in the receiving step; a temperature-data recording step of recording the period of time when the user stays in the first area which is clocked in the clocking step, and recording the temperature data received in the receiving step as a temporal change in the temperature of the first area by relating this temperature data to the period of time clocked in the clocking step; an execution-time calculating step of, using the period of time when the user stays in the first area, the temporal change in the temperature and a reference temperature that is a predetermined temperature which are recorded in the temperature-data recording step, calculating an execution time to execute a control operation of the air-conditioning equipment, based on control information stored in a control-information storing section for storing the control information for changing the contents of a setting in air-conditioning equipment provided in a second area different from the first area; and an operation-data generating step of, generating operation data for operating the air-conditioning equipment during the execution time calculated in the execution-time calculating step based on the control information stored in the control-information storing section.

Moreover, a control program according to the present invention, allowing a control unit to function as: a receiving section for receiving user information indicating the state of a user in a first area and temperature data in the first area; a clocking section for clocking a period of time when the user stays in the first area, based on the user information received by the receiving section; a temperature-data recording section for recording the period of time when the user stays in the first area which is clocked by the clocking section, and recording the temperature data received by the receiving section as a temporal change in the temperature of the first area by relating this temperature data to the period of time clocked by the clocking section; a control-information storing section for storing control information for changing the contents of a setting in air-conditioning equipment provided in a second area different from the first area; an execution-time calculating section for, using the period of time when the user stays in the first area, the temporal change in the temperature and a reference temperature that is a predetermined temperature which are recorded in the temperature-data recording section, calculating an execution time to execute a control operation of the air-conditioning equipment based on the control information stored in the control-information storing section; and an operation-data generating section for generating operation data for operating the air-conditioning equipment during the execution time calculated by the execution-time calculating section based on the control information stored in the control-information storing section.

In addition, a computer-readable record medium in which a control program is recorded according to the present invention, allowing a control unit to function as: a receiving section for receiving user information indicating the state of a user in a first area and temperature data in the first area; a clocking section for clocking a period of time when the user stays in the first area, based on the user information received by the receiving section; a temperature-data recording section for recording the period of time when the user stays in the first area which is clocked by the clocking section, and recording the temperature data received by the receiving section as a temporal change in the temperature of the first area by relating this temperature data to the period of time clocked by the clocking section; a control-information storing section for storing control information for changing the contents of a setting in air-conditioning equipment provided in a second area different from the first area; an execution-time calculating section for, using the period of time when the user stays in the first area, the temporal change in the temperature and a reference temperature that is a predetermined temperature which are recorded in the temperature-data recording section, calculating an execution time to execute a control operation of the air-conditioning equipment based on the control information stored in the control-information storing section; and an operation-data generating section for generating operation data for operating the air-conditioning equipment during the execution time calculated by the execution-time calculating section based on the control information stored in the control-information storing section.

According to these configurations, user information indicating the state of a user in a first area and temperature data in the first area are received. Based on the received user information, a period of time when the user has stayed in the first area is clocked. Then, the period of time when the user has stayed in the first area is recorded, and by relating the received temperature data to the clocked period of time, this temperature data is recorded as a temporal change in the temperature of the first area in a temperature-data recording section. In a control-information storing section, control information is stored for changing the contents of a setting in air-conditioning equipment provided in a second area different from the first area. Using the period of time when the user has stayed in the first area, the temporal change in the temperature and a reference temperature that is a predetermined temperature which are recorded in the temperature-data recording section, an execution time to execute a control operation of the air-conditioning equipment is calculated based on the control information stored in the control-information storing section. Operation data for operating the air-conditioning equipment during the calculated execution time is generated based on the control information stored in the control-information storing section.

Accordingly, using the period of time when the user has stayed in the first area and the temperature of the first area, an execution time is calculated to execute a control operation of the air-conditioning equipment disposed in the second area based on the control information stored in the control-information storing section. Therefore, the user's environment before entering a room with the air-conditioning equipment is estimated based on time and temperature. Then, a result obtained from the estimation is reflected in the control of the air-conditioning equipment. This helps offer a more comfortable space to the user.

Furthermore, in the above described control unit, it is preferable that the user information include information for detecting whether or not the user stays in the first area.

According to this configuration, the user information includes information for detecting whether the user is present or absent in the first area. Therefore, the fact that the user is present in the first area can be certainly confirmed. This makes it possible to precisely calculate an execution time to execute control of the air-conditioning equipment based on predetermined control information.

Moreover, in the above described control unit, preferably, a desired-temperature data extracting section should be further comprised for outputting a temperature desired by the user to the execution-time calculating section; and as the reference temperature which the execution-time calculating section uses when calculating the execution time, the execution-time calculating section should use the user-desired temperature outputted by the desired-temperature data extracting section.

According to this configuration, using the period of time when the user has stayed in the first area, the temperature of the first area, as well as the user-desired temperature, an execution time is calculated to execute control of the air-conditioning equipment disposed in the second area based on predetermined control information. Therefore, the user-desired temperature can be reflected in the control of the air-conditioning equipment. This helps execute its operation, taking into account the difference in thermal sensation between users.

In addition, in the above described control unit, it is preferable that the desired-temperature data extracting section acquire a room temperature set in the air-conditioning equipment and output this set room temperature as the user-desired temperature to the execution-time calculating section.

According to this configuration, the user-desired temperature is the set room temperature of the air-conditioning equipment disposed in the second area. Therefore, the user-desired temperature can be easily and automatically extracted.

Furthermore, in the above described control unit, preferably, the execution-time calculating section should prescribe a specific time whose time range is defined in advance; and if the period of time when the user stays in the first area exceeds the specific time, the execution-time calculating section should calculate the execution time based on the continuous time equivalent to the specific time within the period of time when the user stays in the first area.

According to this configuration, using a temperature change for a preset specific time during the period of time when the user has stayed in the first area, an execution time to execute an operation of the air-conditioning equipment is calculated based on predetermined control information. Therefore, even if the user spends a long time in the first area, the execution time to execute the operation of the air-conditioning equipment based on the predetermined control information can be prevented from being longer than necessary. Hence, the execution time can be set to a suitable time, thus realizing efficient air-conditioning control.

Moreover, in the above described control unit, it is preferable that if the period of time when the user stays in the first area exceeds the specific time, then the execution-time calculating section calculate the execution time, based on the continuous time from the end point of the period of time when the user stays in the first area to the point which goes back by the specific time.

According to this configuration, during the period of time when the user has stayed in the first area, using a temperature change for the period of time which continues only for a specific time immediately before moving into the second area, an execution time is calculated to execute an operation of the air-conditioning equipment based on predetermined control information. Therefore, even if the user spends a long time in the first area, the user's state for the period of time which continues only for the specific time immediately before moving is reflected in the execution time to execute the operation of the air-conditioning equipment based on the predetermined control information. This makes it possible to realize more comfortable air-conditioning for the user.

In addition, in the above described control unit, preferably, if the period of time when the user stays in the first area exceeds the specific time, then the execution-time calculating section should detect a point of time when the highest temperature or the lowest temperature is recorded during the temporal change in the temperature stored in the temperature-data recording section, and should calculate the execution time based on the continuous time equivalent to the specific time which includes the point of time when the highest temperature or the lowest temperature is recorded.

According to this configuration, during the period of time when the user has stayed in the first area, using a temperature change for a specific time which includes the point of time when the maximum temperature or the minimum temperature is recorded, an execution time is calculated to execute an operation of the air-conditioning equipment based on predetermined control information. Therefore, even if the user spends a long time in the first area, the user's state for the period of time which continues only for the specific time which includes the point of time when the user has stayed under the worst condition before moving into the second area is reflected in the execution time to execute the operation of the air-conditioning equipment based on the predetermined control information. This makes it possible to realize more comfortable air-conditioning for the user.

Furthermore, in the above described control unit, it is preferable that the receiving section receive user information indicating the state of the user in a third area where the user stays while moving from the first area to the second area, and temperature data in the third area; the clocking section clock a period of time when the user stays in the third area, based on the user information received by the receiving section; the temperature-data recording section record the period of time when the user stays in the third area which is clocked by the clocking section, and record the temperature data received by the receiving section as a temporal change in the temperature of the third area by relating this temperature data to the period of time clocked by the clocking section; and using the period of time when the user stays in the first area, the temporal change in the temperature of the first area and a reference temperature that is a predetermined temperature as well as the period of time when the user stays in the third area and the temporal change in the temperature of the third area which are recorded in the temperature-data recording section, the execution-time calculating section calculate an execution time to execute a control operation of the air-conditioning equipment based on the control information stored in the control-information storing section.

According to this configuration, user information indicating the state of a user in a third area where the user has stayed until moving from a first area to a second area, and temperature data in the third area are received. Based on the received user information, a period of time when the user has stayed in the third area is clocked. Then, the clocked period of time when the user has stayed in the third area is recorded, and by relating the received temperature data to this period of time, this temperature data is recorded as a temporal change in the temperature of the third area in the temperature-data recording section. Using the period of time when the user has stayed in the first area, the temporal change in the temperature of the first area and a reference temperature that is a predetermined temperature, as well as the period of time when the user has stayed in the third area, the temporal change in the temperature of the third area which are recorded in the temperature-data recording section, an execution time to execute a control operation of the air-conditioning equipment is calculated based on the control information stored in the control-information storing section.

Therefore, an operation of the air-conditioning equipment based on predetermined control information can be executed for a more suitable period. This makes it possible to execute an efficient operation which can fully satisfy the user with a comfortable feeling by utilizing a natural temperature difference.

Moreover, in the above described control unit, preferably, the setting contents should include at least one of a set room temperature, a set air volume and a set diffused-air temperature; and the execution-time calculating section: should calculate a difference in temperature between the first area and the third area, using the temporal changes in the temperature recorded in the temperature-data recording section; should calculate the quantity of a change in at least one of the set room temperature, the set air volume and the set diffused-air temperature in the air-conditioning equipment, based on this difference in temperature; and should change the control information stored in the control-information storing section to this change quantity.

According to this configuration, the change quantity in the setting contents of control information which is stored in the control-information storing section is calculated based on the temperature difference between the first area and the third area. Therefore, the set room temperature in the air-conditioning equipment can be varied according to the environment of the third area where a user has stayed immediately before moving into the second area. This helps precisely grasp the environment which the user has gradually felt bodily, and thereby, execute a meticulous air-conditioning operation.

In addition, in the above described control unit, it is preferable that if the difference in temperature between the first area and the third area is less than a predetermined value, then the execution-time calculating section consider the first area and the third area to be a single area, and calculate the execution time based on the temporal changes in the temperature during the period of time when the user stays in the first area and the third area.

According to this configuration, if the temperature difference between the first area and the third area is below a predetermined value, the first area and the third area can also be considered to be a single area. Therefore, the case in which a plurality of environments where a user has stayed before moving into the second area are not different largely from each other can be taken into account. This makes it possible to execute air-conditioning control which reflects the user's state more accurately.

Furthermore, in the above described control unit, preferably, if the change quantity exceeds a predetermined range, the execution-time calculating section should correct at least one of the set room temperature, the set air volume and the set diffused-air temperature in the air-conditioning equipment.

According to this configuration, when an operation of the air-conditioning equipment based on predetermined control information is executed in the second area, by setting a limit to operation control of the air-conditioning equipment based on the predetermined control information, the setting contents of the air-conditioning equipment may be corrected so that the environment can be prevented from changing too much from before moving into the second area. This helps keep a user from undergoing a sharp thermal change when moving into the second area from the area immediately before moving into the second area. Thereby, more comfortable air-conditioning operation can be realized.

Moreover, a control unit according to the present invention, comprising: a receiving section for receiving user information indicating the state of a user in a bathroom and the state of the user in a bathtub, and temperature data in the bathroom and temperature data in the bathtub; a clocking section for clocking a period of time when the user stays in the bathroom and a period of time when the user stays in the bathtub, based on the user information received by the receiving section; a temperature-data recording section for recording the period of time when the user stays in the bathroom and the period of time when the user stays in the bathtub which are clocked by the clocking section, and recording the temperature data in the bathroom received by the receiving section as a temporal change in the temperature of the bathroom by relating this temperature data to the period of time clocked by the clocking section and the temperature data in the bathtub received by the receiving section as a temporal change in the temperature of the bathtub by relating this temperature data to the period of time clocked by the clocking section; a control-information storing section for storing control information for changing the contents of a setting in air-conditioning equipment provided in a place different from the bathroom; an execution-time calculating section for, using the period of time when the user stays in the bathroom, the period of time when the user stays in the bathtub, the temporal change in the temperature of the bathroom, the temporal change in the temperature of the bathtub, a predetermined numeric coefficient on the influence of the water inside of the bathtub on the human body, and a reference temperature that is a predetermined temperature which are recorded in the temperature-data recording section, calculating an execution time to execute a control operation of the air-conditioning equipment based on the control information stored in the control-information storing section; and an operation-data generating section for generating operation data for operating the air-conditioning equipment during the execution time calculated by the execution-time calculating section based on the control information stored in the control-information storing section.

According to this configuration, user information indicating the state of a user in a bathroom and the state of the user in a bathtub and temperature data in the bathroom and temperature data in the bathtub are received. Based on the received user information, a period of time when the user has stayed in the bathroom and a period of time when the user has stayed in the bathtub are clocked. Then, the clocked period of time when the user has stayed in the bathroom and the clocked period of time when the user has stayed in the bathtub are recorded, and by relating the received temperature data in the bathroom to the clocked period of time, this temperature data is recorded as a temporal change in the temperature of the bathroom, as well as, by relating the received temperature data in the bathtub to the clocked period of time, this temperature data is recorded as a temporal change in the temperature of the bath bathtub in a temperature-data recording section. In a control-information storing section, control information is stored for changing the contents of a setting in air-conditioning equipment provided in a place different from the bathroom. Then, using the period of time when the user has stayed in the bathroom, the period of time when the user has stayed in the bathtub, the temporal change in the temperature of the bathroom, the temporal change in the temperature of the bathtub, a predetermined numeric coefficient on the influence of the water inside of the bathtub on the human body, and a reference temperature that is a predetermined temperature which are recorded in the temperature-data recording section, an execution time to execute a control operation of the air-conditioning equipment is calculated based on the control information stored in the control-information storing section. Thereafter, operation data for operating the air-conditioning equipment during the calculated execution time is generated based on the control information stored in the control-information storing section.

Therefore, in terms of the environment before the user moves to the place provided with the air-conditioning equipment, the fact that the user not only has stayed in the air but also has soaked in water (i.e., warm water) can be taken into account when the execution time for the air-conditioning equipment is calculated based on predetermined control information. Hence, a specialized system can be realized in a space like a bathroom which is a special environment where warm water as well as air exists together. This makes it possible to realize a more comfortable air-conditioning operation for the user.

In addition, in the above described control unit, it is preferable that the execution-time calculating section calculate an execution time to execute a control operation of the air-conditioning equipment, based on a result obtained by comparing the temporal change in the temperature of the bathtub stored in the temperature-data recording section with a predetermined threshold value.

According to this configuration, according to how long a user has soaked in the water of a bathtub while bathing and what the water's temperature is, the user's state is decided. This decision result is reflected in the execution time based on predetermined control information of the air-conditioning equipment. Therefore, even if a user changes how to take a bath every time, such a changed manner can be faithfully reflected in the air-conditioning operation. This helps offer a comfortable air-conditioning operation to the user after the bathing. Besides, this air-conditioning follows the user's bathing manner closely, so that excessive air-conditioning can be avoided. Thereby, the air-conditioning equipment can be controlled using the contents of an appropriate setting.

Furthermore, a control system according to the present invention, comprising: a control unit having a receiving section for receiving user information indicating the state of a user in a first area and temperature data in the first area, a clocking section for clocking a period of time when the user stays in the first area, based on the user information received by the receiving section, a temperature-data recording section for recording the period of time when the user stays in the first area which is clocked by the clocking section, and recording the temperature data received by the receiving section as a temporal change in the temperature of the first area by relating this temperature data to the period of time clocked by the clocking section, a control-information storing section for storing control information for changing the contents of a setting in air-conditioning equipment provided in a second area different from the first area, an execution-time calculating section for, using the period of time when the user stays in the first area, the temporal change in the temperature and a reference temperature that is a predetermined temperature which are recorded in the temperature-data recording section, calculating an execution time to execute a control operation of the air-conditioning equipment based on the control information stored in the control-information storing section, an operation-data generating section for generating operation data for operating the air-conditioning equipment during the execution time calculated by the execution-time calculating section based on the control information stored in the control-information storing section, and an operation-data transmitting section for transmitting the operation data generated by the operation-data generating section to the air-conditioning equipment; a state detecting section for detecting the state of the user in the first area and transmitting the user information indicating the state of the user to the control unit; a temperature detecting section for detecting the temperature of the first area and transmitting the temperature data in the first area to the control unit; and the air-conditioning equipment having an operation-data receiving section for receiving the operation data transmitted by the control unit and an operation executing section for executing an operation according to the operation data received by the operation-data receiving section.

According to this configuration, in a control unit, user information indicating the state of a user in a first area and temperature data in the first area are received. Based on the received user information, a period of time when the user has stayed in the first area is clocked. Then, the period of time when the user has stayed in the first area is recorded, and by relating the received temperature data to the clocked period of time, this temperature data is recorded as a temporal change in the temperature of the first area in a temperature-data recording section. In a control-information storing section, control information is stored for changing the contents of a setting in air-conditioning equipment provided in a second area different from the first area. Using the period of time when the user has stayed in the first area, the temporal change in the temperature and a reference temperature that is a predetermined temperature which are recorded in the temperature-data recording section, an execution time to execute a control operation of the air-conditioning equipment is calculated based on the control information stored in the control-information storing section. Operation data for operating the air-conditioning equipment during the calculated execution time is generated based on the control information stored in the control-information storing section. Then, the generated operation data is transmitted to the air-conditioning equipment. In a state detecting section, the state of the user in the first area is detected, and the user information indicating the state of the user is transmitted to the control unit. Further, a temperature detecting section detects the temperature of the first area, and the temperature data in the first area is transmitted to the control unit. Still further, in the air-conditioning equipment, the operation data transmitted by the control unit is received, and an operation is executed according to the received operation data.

Accordingly, using the period of time when the user has stayed in the first area and the temperature of the first area, an execution time is calculated to execute a control operation of the air-conditioning equipment disposed in the second area based on the control information stored in the control-information storing section. Therefore, the user's environment before entering a room with the air-conditioning equipment is estimated based on time and temperature. Then, a result obtained from the estimation is reflected in the control of the air-conditioning equipment. This helps offer a more comfortable space to the user.

In addition, in the above described control system, preferably, the receiving section should receive user information indicating the state of the user in a third area where the user stays while moving from the first area to the second area, and temperature data in the third area; the clocking section should clock a period of time when the user stays in the third area, based on the user information received by the receiving section; the temperature-data recording section should record the period of time when the user stays in the third area which is clocked by the clocking section, and should record the temperature data received by the receiving section as a temporal change in the temperature of the third area by relating this temperature data to the period of time clocked by the clocking section; using the period of time when the user stays in the first area, the temporal change in the temperature of the first area and a reference temperature that is a predetermined temperature as well as the period of time when the user stays in the third area and the temporal change in the temperature of the third area which are recorded in the temperature-data recording section, the execution-time calculating section should calculate an execution time to execute a control operation of the air-conditioning equipment based on the control information stored in the control-information storing section; and the control system should further include a state detecting section for detecting the state of the user in the third area and transmitting the user information indicating the state of the user to the control unit, and a temperature detecting section for detecting the temperature of the third area and transmitting the temperature data in the third area to the control unit.

According to this configuration, in the control unit, user information indicating the state of a user in a third area where the user has stayed until moving from a first area to a second area, and temperature data in the third area are received. Based on the received user information, a period of time when the user has stayed in the third area is clocked. Then, the clocked period of time when the user has stayed in the third area is recorded, and by relating the received temperature data to this period of time, this temperature data is recorded as a temporal change in the temperature of the third area in the temperature-data recording section. Using the period of time when the user has stayed in the first area, the temporal change in the temperature of the first area and a reference temperature that is a predetermined temperature, as well as the period of time when the user has stayed in the third area, the temporal change in the temperature of the third area which are recorded in the temperature-data recording section, an execution time to execute a control operation of the air-conditioning equipment is calculated based on the control information stored in the control-information storing section. Then, in a state detecting section, the user's state in the third area is detected, and the user information indicating the user's state is transmitted to the control unit. Sequentially, in a temperature detecting section, the temperature of the third area is detected, and the temperature data in the third area is transmitted to the control unit.

Therefore, an operation of the air-conditioning equipment based on predetermined control information can be executed for a more suitable period. This makes it possible to execute an efficient operation which can fully satisfy the user with a comfortable feeling by utilizing a natural temperature difference.

Moreover, a control system according to the present invention, comprising: a control unit having a receiving section for receiving user information indicating the state of a user in a bathroom and the state of the user in a bathtub, and temperature data in the bathroom and temperature data in the bathtub, a clocking section for clocking a period of time when the user stays in the bathroom and a period of time when the user stays in the bathtub, based on the user information received by the receiving section, a temperature-data recording section for recording the period of time when the user stays in the bathroom and the period of time when the user stays in the bathtub which are clocked by the clocking section, and recording the temperature data in the bathroom received by the receiving section as a temporal change in the temperature of the bathroom by relating this temperature data to the period of time clocked by the clocking section and the temperature data in the bathtub received by the receiving section as a temporal change in the temperature of the bathtub by relating this temperature data to the period of time clocked by the clocking section, a control-information storing section for storing control information for changing the contents of a setting in air-conditioning equipment provided in a place different from the bathroom, an execution-time calculating section for, using the period of time when the user stays in the bathroom, the period of time when the user stays in the bathtub, the temporal change in the temperature of the bathroom, the temporal change in the temperature of the bathtub, a predetermined numeric coefficient on the influence of the water inside of the bathtub on the human body, and a reference temperature that is a predetermined temperature which are recorded in the temperature-data recording section, calculating an execution time to execute a control operation of the air-conditioning equipment based on the control information stored in the control-information storing section, an operation-data generating section for generating operation data for operating the air-conditioning equipment during the execution time calculated by the execution-time calculating section based on the control information stored in the control-information storing section, and an operation-data transmitting section for transmitting the operation data generated by the operation-data generating section to the air-conditioning equipment; a bathroom-state detecting section for detecting the state of the user in the bathroom and transmitting the user information indicating the state of the user to the control unit; a bathtub-state detecting section for detecting the state of the user in the bathtub and transmitting the user information indicating the state of the user to the control unit; a bathroom-temperature detecting section for detecting the temperature of the bathroom and transmitting the temperature data in the bathroom to the control unit; a bathtub-temperature detecting section for detecting the temperature of the bathtub and transmitting the temperature data in the bathtub to the control unit; and the air-conditioning equipment having an operation-data receiving section for receiving the operation data transmitted by the control unit and an operation executing section for executing an operation according to the operation data received by the operation-data receiving section.

According to this configuration, user information indicating the state of a user in a bathroom and the state of the user in a bathtub and temperature data in the bathroom and temperature data in the bathtub are received. Based on the received user information, a period of time when the user has stayed in the bathroom and a period of time when the user has stayed in the bathtub are clocked. Then, the clocked period of time when the user has stayed in the bathroom and the clocked period of time when the user has stayed in the bathtub are recorded, and by relating the received temperature data in the bathroom to the clocked period of time, this temperature data is recorded as a temporal change in the temperature of the bathroom, as well as, by relating the received temperature data in the bathtub to the clocked period of time, this temperature data is recorded as a temporal change in the temperature of the bath bathtub in a temperature-data recording section. In a control-information storing section, control information is stored for changing the contents of a setting in air-conditioning equipment provided in a place different from the bathroom. Then, using the period of time when the user has stayed in the bathroom, the period of time when the user has stayed in the bathtub, the temporal change in the temperature of the bathroom, the temporal change in the temperature of the bathtub, a predetermined numeric coefficient on the influence of the water inside of the bathtub on the human body, and a reference temperature that is a predetermined temperature which are recorded in the temperature-data recording section, an execution time to execute a control operation of the air-conditioning equipment is calculated based on the control information stored in the control-information storing section. Thereafter, operation data for operating the air-conditioning equipment during the calculated execution time is generated based on the control information stored in the control-information storing section. Then, the generated operation data is transmitted to the air-conditioning equipment. In a bathroom-state detecting section, the state of the user in the bathroom is detected, and the user information indicating the state of the user is transmitted to the control unit. Further, in a bathtub-state detecting section, the state of the user in the bathtub is detected, and the user information indicating the state of the user is transmitted to the control unit. In a bathroom-temperature detecting section, the temperature of the bathroom is detected, and the temperature data in the bathroom is transmitted to the control unit. Further, in a bathtub-temperature detecting section, the temperature of the bathtub is detected, and the temperature data in the bathtub is transmitted to the control unit. Still further, in the air-conditioning equipment, the operation data transmitted by the control unit is received, and an operation is executed according to the received operation data.

Therefore, in terms of the environment before the user moves to the place provided with the air-conditioning equipment, the fact that the user not only has stayed in the air but also has soaked in water (i.e., warm water) can be taken into account when the execution time for the air-conditioning equipment is calculated based on predetermined control information. Hence, a specialized system can be realized in a space like a bathroom which is a special environment where warm water as well as air exists together. This makes it possible to realize a more comfortable air-conditioning operation for the user.

INDUSTRIAL APPLICABILITY

The control unit, control method, control program, computer-readable record medium where a control program is recorded, and a control system according to the present invention are useful as a control unit, a control method, a control program, a computer-readable record medium where a control program is recorded, a control system, and the like, for air-conditioning equipment or the like, which are capable of detecting an environment where a user has stayed before entering a room, and reflecting data obtained from the detection in air-conditioning control after entering the room.

The invention claimed is:

1. A control unit, comprising:

a receiving section for receiving user information indicating the state of a user in a first area and temperature data in the first area;

a clocking section for clocking a period of time when the user stays in the first area, based on the user information received by the receiving section;

a temperature-data recording section for recording the period of time when the user stays in the first area which is clocked by the clocking section, and recording the temperature data received by the receiving section as a temporal change in the temperature of the first area by relating this temperature data to the period of time clocked by the clocking section;

a control-information storing section for storing control information for changing the contents of a setting in air-conditioning equipment provided in a second area different from the first area;

an execution-time calculating section for, using the period of time when the user stays in the first area, the temporal change in the temperature and a reference temperature that is a predetermined temperature which are recorded in the temperature-data recording section, calculating an execution time to execute a control operation of the air-conditioning equipment based on the control information stored in the control-information storing section; and an operation-data generating section for generating operation data for operating the air-conditioning equipment during the execution time calculated by the execution-time calculating section based on the control information stored in the control-information storing section.

2. The control unit according to claim 1, wherein the user information includes information for detecting whether or not the user stays in the first area.

3. The control unit according to claim 1, further comprising a desired-temperature data extracting section for outputting a temperature desired by the user to the execution-time calculating section, wherein as the reference temperature which the execution-time calculating section uses when calculating the execution time, the execution-time calculating section uses the user-desired temperature outputted by the desired-temperature data extracting section.

4. The control unit according to claim 3, wherein the desired-temperature data extracting section acquires a room temperature set in the air-conditioning equipment and outputs this set room temperature as the user-desired temperature to the execution-time calculating section.

5. The control unit according to claim 1, wherein:

the execution-time calculating section prescribes a specific time whose time range is defined in advance; and if the period of time when the user stays in the first area exceeds the specific time, the execution-time calculating section calculates the execution time based on the continuous time equivalent to the specific time within the period of time when the user stays in the first area.

6. The control unit according to claim 5, wherein if the period of time when the user stays in the first area exceeds the specific time, then the execution-time calculating section calculates the execution time, based on the continuous time from the end point of the period of time when the user stays in the first area to the point which goes back by the specific time.

7. The control unit according to claim 5, wherein if the period of time when the user stays in the first area exceeds the specific time, then the execution-time calculating section detects a point of time when the highest temperature or the lowest temperature is recorded during the temporal change in the temperature stored in the temperature-data recording section, and calculates the execution time based on the continuous time equivalent to the specific time which includes the point of time when the highest temperature or the lowest temperature is recorded.

8. The control unit according to claim 1, wherein: the receiving section receives user information indicating the state of the user in a third area where the user stays while moving from the first area to the second area, and temperature data in the third area;

the clocking section clocks a period of time when the user stays in the third area, based on the user information received by the receiving section;

the temperature-data recording section records the period of time when the user stays in the third area which is clocked by the clocking section, and records the temperature data received by the receiving section as a temporal change in the temperature of the third area by relating this temperature data to the period of time clocked by the clocking section; and using the period of time when the user stays in the first area, the temporal change in the temperature of the first area and a reference temperature that is a predetermined temperature as well as the period of time when the user stays in the third area and the temporal change in the temperature of the third area which are recorded in the temperature-data recording section, the execution-time calculating section calculates an execution time to execute a control operation of the air-conditioning equipment based on the control information stored in the control-information storing section.

9. The control unit according to claim 8, wherein:

the setting contents include at least one of a set room temperature, a set air volume and a set diffused-air temperature; and the execution-time calculating section: calculates a difference in temperature between the first area and the third area, using the temporal changes in the temperature recorded in the temperature-data recording section; calculates the quantity of a change in at least one of the set room temperature, the set air volume and the set diffused-air temperature in the air-conditioning equipment, based on this difference in temperature; and changes the control information stored in the control-information storing section to this change quantity.

10. The control unit according to claim 9, wherein if the difference in temperature between the first area and the third area is less than a predetermined value, then the execution-time calculating section considers the first area and the third area to be a single area, and calculates the execution time based on the temporal changes in the temperature during the period of time when the user stays in the first area and the third area.

11. The control unit according to claim 9, wherein if the change quantity exceeds a predetermined range, the execution-time calculating section corrects at least one of the set room temperature, the set air volume and the set diffused-air temperature in the air-conditioning equipment.

12. A control unit, comprising:

a receiving section for receiving user information indicating the state of a user in a bathroom and the state of the user in a bathtub, and temperature data in the bathroom and temperature data in the bathtub;

a clocking section for clocking a period of time when the user stays in the bathroom and a period of time when the user stays in the bathtub, based on the user information received by the receiving section;

a temperature-data recording section for recording the period of time when the user stays in the bathroom and the period of time when the user stays in the bathtub which are clocked by the clocking section, and recording the temperature data in the bathroom received by the receiving section as a temporal change in the temperature of the bathroom by relating this temperature data to the period of time clocked by the clocking section and the temperature data in the bathtub received by the receiving section as a temporal change in the temperature of the bathtub by relating this temperature data to the period of time clocked by the clocking section;

a control-information storing section for storing control information for changing the contents of a setting in air-conditioning equipment provided in a place different from the bathroom;

an execution-time calculating section for, using the period of time when the user stays in the bathroom, the period of time when the user stays in the bathtub, the temporal change in the temperature of the bathroom, the temporal change in the temperature of the bathtub, a predetermined numeric coefficient on the influence of the water inside of the bathtub on the human body and a reference temperature that is a predetermined temperature which are recorded in the temperature-data recording section, calculating an execution time to execute a control operation of the air-conditioning equipment based on the control information stored in the control-information storing section; and an operation-data generating section for generating operation data for operating the air-conditioning equipment during the execution time calculated by the execution-time calculating section based on the control information stored in the control-information storing section.

13. The control unit according to claim 12, wherein the execution-time calculating section calculates an execution time to execute a control operation of the air- conditioning equipment, based on a result obtained by comparing the temporal change in the temperature of the bathtub stored in the temperature-data recording section with a predetermined threshold value.

14. A control system, comprising:

a control unit having, a receiving section for receiving user information indicating the state of a user in a first area and temperature data in the first area, a clocking section for clocking a period of time when the user stays in the first area, based on the user information received by the receiving section, a temperature-data recording section for recording the period of time when the user stays in the first area which is clocked by the clocking section, and recording the temperature data received by the receiving section as a temporal change in the temperature of the first area by relating this temperature data to the period of time clocked by the clocking section, a control-information storing section for storing control information for changing the contents of a setting in air-conditioning equipment provided in a second area different from the first area, an execution-time calculating section for, using the period of time when the user stays in the first area, the temporal change in the temperature and a reference temperature that is a predetermined temperature which are recorded in the temperature-data recording section, calculating an execution time to execute a control operation of the air-conditioning equipment based on the control information stored in the control-information storing section, an operation-data generating section for generating operation data for operating the air-conditioning equipment during the execution time calculated by the execution-time calculating section based on the control information stored in the control-information storing section, and an operation-data transmitting section for transmitting the operation data generated by the operation-data generating section to the air-conditioning equipment;

a state detecting section for detecting the state of the user in the first area and transmitting the user information indicating the state of the user to the control unit;

a temperature detecting section for detecting the temperature of the first area and transmitting the temperature data in the first area to the control unit; and the air-conditioning equipment having an operation-data receiving section for receiving the operation data transmitted by the control unit and an operation executing section for executing an operation according to the operation data received by the operation-data receiving section.

15. The control system according to claim 14, wherein:

the receiving section receives user information indicating the state of the user in a third area where the user stays while moving from the first area to the second area, and temperature data in the third area;

the clocking section clocks a period of time when the user stays in the third area, based on the user information received by the receiving section;

the temperature-data recording section records the period of time when the user stays in the third area which is clocked by the clocking section, and records the temperature data received by the receiving section as a temporal change in the temperature of the third area by relating this temperature data to the period of time clocked by the clocking section;

using the period of time when the user stays in the first area, the temporal change in the temperature of the first area and a reference temperature that is a predetermined temperature as well as the period of time when the user stays in the third area and the temporal change in the temperature of the third area which are recorded in the temperature-data recording section, the execution-time calculating section calculates an execution time to execute a control operation of the air-conditioning equipment based on the control information stored in the control-information storing section; and the control system further comprises, a state detecting section for detecting the state of the user in the third area and transmitting the user information indicating the state of the user to the control unit, and a temperature detecting section for detecting the temperature of the third area and transmitting the temperature data in the third area to the control unit.

16. A control system, comprising:

a control unit having, a receiving section for receiving user information indicating the state of a user in a bathroom and the state of the user in a bathtub, and temperature data in the bathroom and temperature data in the bathtub, a clocking section for clocking a period of time when the user stays in the bathroom and a period of time when the user stays in the bathtub, based on the user information received by the receiving section, a temperature-data recording section for recording the period of time when the user stays in the bathroom and the period of time when the user stays in the bathtub which are clocked by the clocking section, and recording the temperature data in the bathroom received by the receiving section as a temporal change in the temperature of the bathroom by relating this temperature data to the period of time clocked by the clocking section and the temperature data in the bathtub received by the receiving section as a temporal change in the temperature of the bathtub by relating this temperature data to the period of time clocked by the clocking section, a control-information storing section for storing control information for changing the contents of a setting in air-conditioning equipment provided in a place different from the bathroom, an execution-time calculating section for, using the period of time when the user stays in the bathroom, the period of time when the user stays in the bathtub, the temporal change in the temperature of the bathroom, the temporal change in the temperature of the bathtub, a predetermined numeric coefficient on the influence of the water inside of the bathtub on the human body and a reference temperature that is a predetermined temperature which are recorded in the temperature-data recording section, calculating an execution time to execute a control operation of the air-conditioning equipment based on the control information stored in the control-information storing section, an operation-data generating section for generating operation data for operating the air-conditioning equipment during the execution time calculated by the execution-time calculating section based on the control information stored in the control-information storing section, and an operation-data transmitting section for transmitting the operation data generated by the operation-data generating section to the air-conditioning equipment;

a bathroom-state detecting section for detecting the state of the user in the bathroom and transmitting the user information indicating the state of the user to the control unit;

a bathtub-state detecting section for detecting the state of the user in the bathtub and transmitting the user information indicating the state of the user to the control unit;

a bathroom-temperature detecting section for detecting the temperature of the bathroom and transmitting the temperature data in the bathroom to the control unit;

a bathtub-temperature detecting section for detecting the temperature of the bathtub and transmitting the temperature data in the bathtub to the control unit; and the air-conditioning equipment having an operation-data receiving section for receiving the operation data transmitted by the control unit and an operation executing section for executing an operation according to the operation data received by the operation-data receiving section.

17. A control method, including:

a receiving step of receiving user information indicating the state of a user in a first area and temperature data in the first area;

a clocking step of clocking a period of time when the user stays in the first area, based on the user information received in the receiving step;

a temperature-data recording step of recording the period of time when the user stays in the first area which is clocked in the clocking step, and recording the temperature data received in the receiving step as a temporal change in the temperature of the first area by relating this temperature data to the period of time clocked in the clocking step;

an execution-time calculating step of, using the period of time when the user stays in the first area, the temporal change in the temperature and a reference temperature that is a predetermined temperature which are recorded in the temperature-data recording step, calculating an execution time to execute a control operation of the air-conditioning equipment, based on control information stored in a control-information storing section for storing the control information for changing the contents of a setting in air-conditioning equipment provided in a second area different from the first area; and an operation-data generating step of, generating operation data for operating the air-conditioning equipment during the execution time calculated in the execution-time calculating step based on the control information stored in the control-information storing section.

18. A computer-readable record medium in which a control program is recorded, allowing a control unit to function as:

a receiving section for receiving user information indicating the state of a user in a first area and temperature data in the first area;

a clocking section for clocking a period of time when the user stays in the first area, based on the user information received by the receiving section;

a temperature-data recording section for recording the period of time when the user stays in the first area which is clocked by the clocking section, and recording the temperature data received by the receiving section as a temporal change in the temperature of the first area by relating this temperature data to the period of time clocked by the clocking section;

a control-information storing section for storing control information for changing the contents of a setting in air-conditioning equipment provided in a second area different from the first area;

an execution-time calculating section for, using the period of time when the user stays in the first area, the temporal change in the temperature and a reference temperature that is a predetermined temperature which are recorded in the temperature-data recording section, calculating an execution time to execute a control operation of the air-conditioning equipment based on the control information stored in the control-information storing section; and an operation-data generating section for generating operation data for operating the air-conditioning equipment during the execution time calculated by the execution-time calculating section based on the control information stored in the control-information storing section.

* * * * *